US012158298B2

(12) United States Patent
Ishimizu

(10) Patent No.: US 12,158,298 B2
(45) Date of Patent: Dec. 3, 2024

(54) ICE MAKING DEVICE

(71) Applicant: NIDEC SANKYO CORPORATION, Nagano (JP)

(72) Inventor: Akio Ishimizu, Nagano (JP)

(73) Assignee: NIDEC SANKYO CORPORATION, Nagano (JP)

( * ) Notice: Subject to any disclaimer, the term of this patent is extended or adjusted under 35 U.S.C. 154(b) by 150 days.

(21) Appl. No.: 18/146,452

(22) Filed: Dec. 26, 2022

(65) Prior Publication Data

US 2023/0204272 A1 Jun. 29, 2023

(30) Foreign Application Priority Data

Dec. 27, 2021 (JP) ..... 2021-212869

(51) Int. Cl.
*F25C 1/246* (2018.01)
*F25C 5/187* (2018.01)
*F25C 5/20* (2018.01)

(52) U.S. Cl.
CPC ..... *F25C 1/246* (2013.01); *F25C 5/187* (2013.01); *F25C 5/22* (2018.01); *F25C 2305/0221* (2021.08); *F25C 2700/02* (2013.01)

(58) Field of Classification Search
CPC ..... F25C 1/246; F25C 5/187; F25C 5/22
See application file for complete search history.

(56) References Cited

U.S. PATENT DOCUMENTS 11,137,186 B2 * 10/2021 Saito ..... F25C 5/185
11,466,917 B2 10/2022 Ishimizu
2019/0063812 A1 * 2/2019 Saito ..... F25C 5/06

* cited by examiner

*Primary Examiner* — James Sanders
(74) *Attorney, Agent, or Firm* — HAUPTMAN HAM, LLP

(57) ABSTRACT

An ice making device includes a restriction mechanism for restricting an ice detection lever from moving to a lower side than a restriction position. The restriction mechanism includes a restriction member, a wire spring attached to the restriction member, an opening part and a protruded part provided in the frame. A restriction part of the restriction member is capable of moving between a first rotation position and a second rotation position. When the restriction member is located at the first rotation position, the protruded part elastically deforms the wire spring and urges the restriction member to the first rotation position and, when the restriction member is located at the second rotation position, the protruded part elastically deforms the wire spring and urges the restriction member to the second rotation position. When the restriction member is located at the second rotation position, the restriction part is disposed at the restriction position.

7 Claims, 18 Drawing Sheets

ICE MAKING DEVICE

CROSS REFERENCE TO RELATED APPLICATION

The present invention claims priority under 35 U.S.C. § 119 to Japanese Application No. 2021-212869 filed Dec. 27, 2021, the entire content of which is incorporated herein by reference.

TECHNICAL FIELD

At least an embodiment of the present invention may relate to an ice making device which is structured to drop ice pieces from an ice tray after an amount of ice pieces existing on a lower side with respect to the ice tray has been confirmed by an ice detection lever.

BACKGROUND

An ice making device which is mounted on a refrigerator is described in Japanese Patent Laid-Open No. 2021-092352 (Patent Literature 1). The ice making device described in Patent Literature 1 includes an ice tray, a frame made of resin which supports the ice tray, and an ice detection member for detecting an amount of ice pieces stored in an ice storage container which is located on a lower side with respect to the ice tray. The frame is formed in a frame shape. The ice tray and the ice detection member are arranged on an inner side of the frame. Further, the ice making device includes a drive part for driving the ice detection member and the ice tray. The drive part is structured to move the ice detection member downward from a first position located on an upper side with respect to the ice storage container toward a second position which is in an inside of the ice storage container. In this case, when the ice detection member has moved to a lower side than the second position, it is recognized that an amount of ice pieces within the ice storage container is reduced and thus, the drive part drives the ice tray. The ice tray is driven and vertically inverted by the drive part. As a result, ice pieces of the ice tray are dropped to the ice storage container.

The ice making device described in Patent Literature 1 includes a restriction mechanism for stopping an ice making operation. The restriction mechanism includes a restriction member which is rotatably supported by the frame and a guide groove in a circular arc shape which is formed in the frame so as to be concentric with a rotation shaft of the restriction member. The restriction member is provided with a main body part which is located on an outer side of the frame and a restriction part which is protruded from the main body part so as to penetrate through the guide groove and is extended to an inner side of the frame. The restriction member is turned between a first rotation position where the restriction part is abutted with a first opening edge located at one end in a circumferential direction of the guide groove and a second rotation position where the restriction part is abutted with the other opening edge of the guide groove. When the restriction member is located at the first rotation position, the restriction part is separated from a trajectory of the ice detection member which is moved between the first position and the second position to permit a downward movement of the ice detection member. Further, when the restriction member is located at the second rotation position, the restriction part is abutted with the ice detection member at a restriction position between the first position and the second position to restrict the downward movement of the ice detection member to a lower side than the restriction position. Therefore, when the restriction member is located at the second rotation position, the ice detection member is not moved below the restriction position. As a result, ice pieces of the ice tray are not discharged from the ice tray and an ice making operation of the ice making device is stopped.

The restriction part of the restriction member is provided with a protruded part which is protruded to an inner peripheral side. On the other hand, an edge on an inner peripheral side of the guide groove in the frame is provided with a first holding groove and a second holding groove which are recessed to an inner peripheral side. When the restriction member is disposed at the first rotation position, the protruded part is fitted to the first holding groove. As a result, the restriction member is held at the first rotation position. Further, when the restriction member is disposed at the second rotation position, the protruded part is fitted to the second holding groove. As a result, the restriction member is held at the second rotation position. In the frame described in Patent Literature 1, a first arm part provided with the first holding groove and a second arm part provided with the second holding groove are provided in opening edge portions of the guide groove and are elastically deformable in a direction approaching a rotation shaft of the restriction member. Therefore, when the restriction member is to be disposed at the first rotation position, the first arm part is resiliently bent to an inner peripheral side and holds the protruded part in the first holding groove. Further, when the restriction member is to be disposed at the second rotation position, the second arm part is resiliently bent to an inner peripheral side and holds the protruded part in the second holding groove.

Engagement of the restriction member with the frame when the restriction member is to be held by the frame is engagement of the protruded part with the holding groove. Further, the arm part which is provided with the holding groove in the frame is elastically deformable in a direction separated from the protruded part. Therefore, engagement of the protruded part with the holding groove may be disengaged from each other due to vibration occurred in a refrigerator or the like. When engagement of the protruded part with the holding groove is disengaged, the restriction member is capable of moving from the first rotation position and the second rotation position in a circumferential direction. Further, since the frame is made of resin, when an operation of moving the restriction member from the first rotation position to the second rotation position is repeated, the arm part having the holding groove may be damaged due to repetition of elastic deformation. When the arm part is damaged, the restriction member becomes movable from the first rotation position and the second rotation position. In this case, when the restriction member is moved from the first rotation position, it may be occurred that the restriction part of the restriction member enters on a trajectory of the ice detection member and downward movement of the ice detection member is prevented.

SUMMARY

In view of the problem described above, at least an embodiment of the present invention may advantageously provide an ice making device in which a restriction member which is located at the first rotation position or the second rotation position is restrained from moving from the respective rotation positions.

According to at least an embodiment of the present invention, there may be provided an ice making device including an ice tray, a frame which is formed in a frame shape and supports the ice tray, an ice detection lever which is provided on an inner peripheral side of the frame and is structured to detect an amount of ice pieces stored on a lower side with respect to the ice tray, a drive part which is structured to drive the ice detection lever to a lower side from a first position and drive the ice tray to discharge ice pieces when the ice detection lever is moved downward to a lower side than a second position, and a restriction mechanism which restricts the ice detection lever from moving to a lower side than a restriction position between the first position and the second position. The restriction mechanism includes a restriction member which is turnably supported by the frame, a wire spring which is made of metal and is attached to the restriction member, an opening part in a circular arc shape which is concentrically formed with a rotation shaft of the restriction member in the frame, and a protruded part which is provided on an outer side face of the frame at a position overlapping with the restriction member when viewed in an axial line direction along the rotation shaft. The restriction member includes a main body part which is located on an outer side of the frame, and a restriction part which is protruded from the main body part so as to penetrate through the opening part and is extended to an inner side of the frame. The restriction part is capable of moving between a first rotation position, where the restriction part is abutted with a first opening edge which is one edge in a circumferential direction of the opening part, and a second rotation position where the restriction part is abutted with a second opening edge which is the other edge in the circumferential direction of the opening part and, when the restriction member is located at the first rotation position, the protruded part is contacted with the wire spring to elastically deform the wire spring and urge the restriction member to the first opening edge and, when the restriction member is located at the second rotation position, the protruded part is contacted with the wire spring to elastically deform the wire spring and urge the restriction member to the second opening edge. When the restriction member is located at the first rotation position, the restriction part is separated from a trajectory of the ice detection lever which is moved from the first position toward the second position and, when the restriction member is located at the second rotation position, the restriction part is disposed at the restriction position to be capable of abutting with the ice detection lever.

According to at least an embodiment of the present invention, when the restriction member is disposed at the first rotation position where a downward movement of the ice detection lever is permitted, the protruded part provided in the frame is contacted with the wire spring attached to the restriction member to elastically deform the wire spring and urges the restriction member to the first opening edge of the opening part provided in the frame. In other words, when the restriction member is disposed at the first rotation position, the restriction member is urged to the first opening edge by a shape restoring force generated in the wire spring due to elastic deformation. Therefore, the restriction member can be restrained from moving from the first rotation position due to vibration or the like. Further, when the restriction member is disposed at the second rotation position where a downward movement of the ice detection lever is prevented, the protruded part provided in the frame is contacted with the wire spring which is attached to the restriction member to elastically deform the wire spring and urges the restriction member to the second opening edge of the opening part provided in the frame. In other words, when the restriction member is disposed at the second rotation position, the restriction member is urged to the second opening edge by a shape restoring force generated in the wire spring due to elastic deformation. Therefore, the restriction member can be restrained from moving from the second rotation position. Further, the restriction member is urged by the wire spring made of metal. Therefore, even when the wire spring is repeatedly elastically deformed, the wire spring is less likely to be damaged in comparison with a case that a resin member is repeatedly elastically deformed. Accordingly, the restriction member disposed at the first rotation position and the second rotation position can be restrained from moving from the respective rotation positions.

In at least an embodiment of the present invention, it may be structured that, in a circumferential direction around an axial line of the rotation shaft, when a direction from the first rotation position toward the second rotation position is defined as a first rotation direction, and a direction from the second rotation position toward the first rotation position is defined as a second rotation direction, in a case that the restriction member is located in the first rotation direction with respect to a third rotation position between the first rotation position and the second rotation position, the protruded part is contacted with the wire spring to elastically deform the wire spring and turn the restriction member toward the second rotation position and, in a case that the restriction member is located in the second rotation direction with respect to the third rotation position, the protruded part is abutted with the wire spring to elastically deform the wire spring and turn the restriction member toward the first rotation position. According to this structure, even in a case that the restriction member is moved to a side of the third rotation position from the first rotation position and, even in a case that the restriction member is moved to a side of the third rotation position from the second rotation position, the restriction member can be returned to the first rotation position or the second rotation position.

In at least an embodiment of the present invention, it may be structured that an outer peripheral face of the protruded part is provided with a first outer peripheral face portion which is extended in the first rotation direction toward a direction separated from the rotation shaft, a second outer peripheral face portion which is extended in the first rotation direction from an end on an outer peripheral side of the first outer peripheral face portion toward a direction approaching the rotation shaft, and an edge line where an end on an outer peripheral side of the first outer peripheral face portion and an end on an outer peripheral side of the second outer peripheral face portion are connected with each other. The first outer peripheral face portion is contacted with the wire spring to elastically deform the wire spring when the restriction member is located at the first rotation position, and the second outer peripheral face portion is contacted with the wire spring to elastically deform the wire spring when the restriction member is located at the second rotation position. According to this structure, the protruded part is contacted with the wire spring at a surface at each of the first rotation position and the second rotation position. As a result, the restriction member can be stably urged to each of the first rotation position and the second rotation position.

In at least an embodiment of the present invention, it may be structured that the edge line is contacted with the wire spring to elastically deform the wire spring when the restriction member is located at the third rotation position. According to this structure, contact of the wire spring with the protruded part is unstable at the third rotation position.

Therefore, the restriction member can be restrained from staying at the third rotation position.

In at least an embodiment of the present invention, it may be structured that the restriction member is provided with a circular arc rib surrounding the rotation shaft on a face of the main body part which faces the frame, the wire spring is provided with a first spring portion in a circular arc shape which is extended in the first rotation direction so as to curve in a direction separated from the rotation shaft, a second spring portion which is extended in the first rotation direction from an end of the first spring portion toward a side of the rotation shaft, a third spring portion which is extended in the first rotation direction from an end of the second spring portion toward an outer peripheral side, and a fourth spring portion which is extended from an end of the third spring portion in the first rotation direction so as to curve in a direction approaching the rotation shaft. The first spring portion and the fourth spring portion sandwich the circular arc rib, the second spring portion and the third spring portion are located between two open ends of the circular arc rib in the circumferential direction, and the first outer peripheral face portion, the second outer peripheral face portion and the edge line of the protruded part are located between the two open ends of the circular arc rib in the circumferential direction. The first outer peripheral face portion is contacted with the third spring portion to elastically deform the wire spring when the restriction member is located at the first rotation position, and the second outer peripheral face portion is contacted with the second spring portion to elastically deform the wire spring when the restriction member is located at the second rotation position. According to this structure, the circular arc rib is sandwiched by the first spring portion and the fourth spring portion and thus, the wire spring is easily attached to the restriction member. Further, according to this structure, when an inclination angle of the third spring portion which is inclined with respect to a radial direction is adjusted, a deforming amount of the wire spring can be adjusted when the first outer peripheral face portion of the protruded part is contacted with the third spring portion. As a result, an urging force by which the restriction member is urged to the first opening edge can be adjusted. Similarly, when an inclination angle of the second spring portion which is inclined with respect to a radial direction is adjusted, a deforming amount of the wire spring can be adjusted when the second outer peripheral face portion of the protruded part is contacted with the second spring portion. As a result, an urging force by which the restriction member is urged to the second opening edge can be adjusted.

In at least an embodiment of the present invention, it may be structured that the edge line is abutted with a bent part where the second spring portion and the third spring portion are connected with each other when the restriction member is located at the third rotation position. According to this structure, contact of the wire spring with the protruded part is unstable at the third rotation position. Therefore, the restriction member can be restrained from staying at the third rotation position.

In at least an embodiment of the present invention, it may be structured that the main body part is provided on an opposing face which faces the frame with a first spring support part which supports one end of the wire spring and a second spring support part which supports the other end of the wire spring, and the wire spring is extended in a straight line shape at a position separated from the rotation shaft when the wire spring is attached to the first spring support part and the second spring support part.

EFFECTS OF THE INVENTION

According to the present invention, the restriction member for restricting a downward movement of the ice detection lever is urged to the first rotation position and the second rotation position by a shape restoring force of the wire spring which is made of metal. Therefore, the restriction member disposed at the first rotation position and the second rotation position can be restrained from moving from the respective rotation positions.

Other features and advantages of the invention will be apparent from the following detailed description, taken in conjunction with the accompanying drawings that illustrate, by way of example, various features of embodiments of the invention.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION

Embodiments of an ice making device to which the present invention is applied will be described below with reference to the accompanying drawings.

(Entire Structure)

Figure 1:
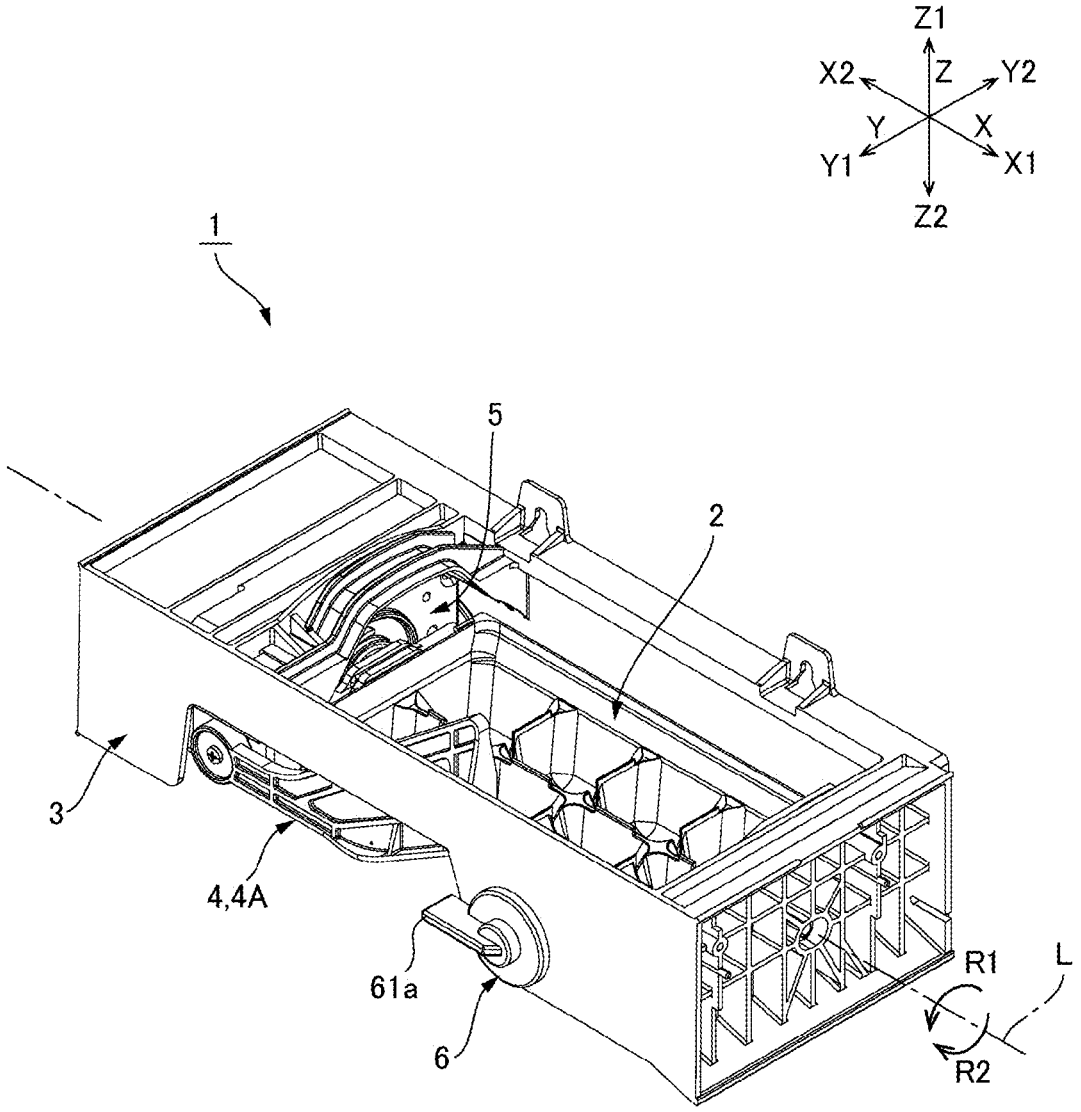
FIG. 1 is a perspective view showing an ice making device in accordance with a first embodiment of the present invention.
Figure 2:
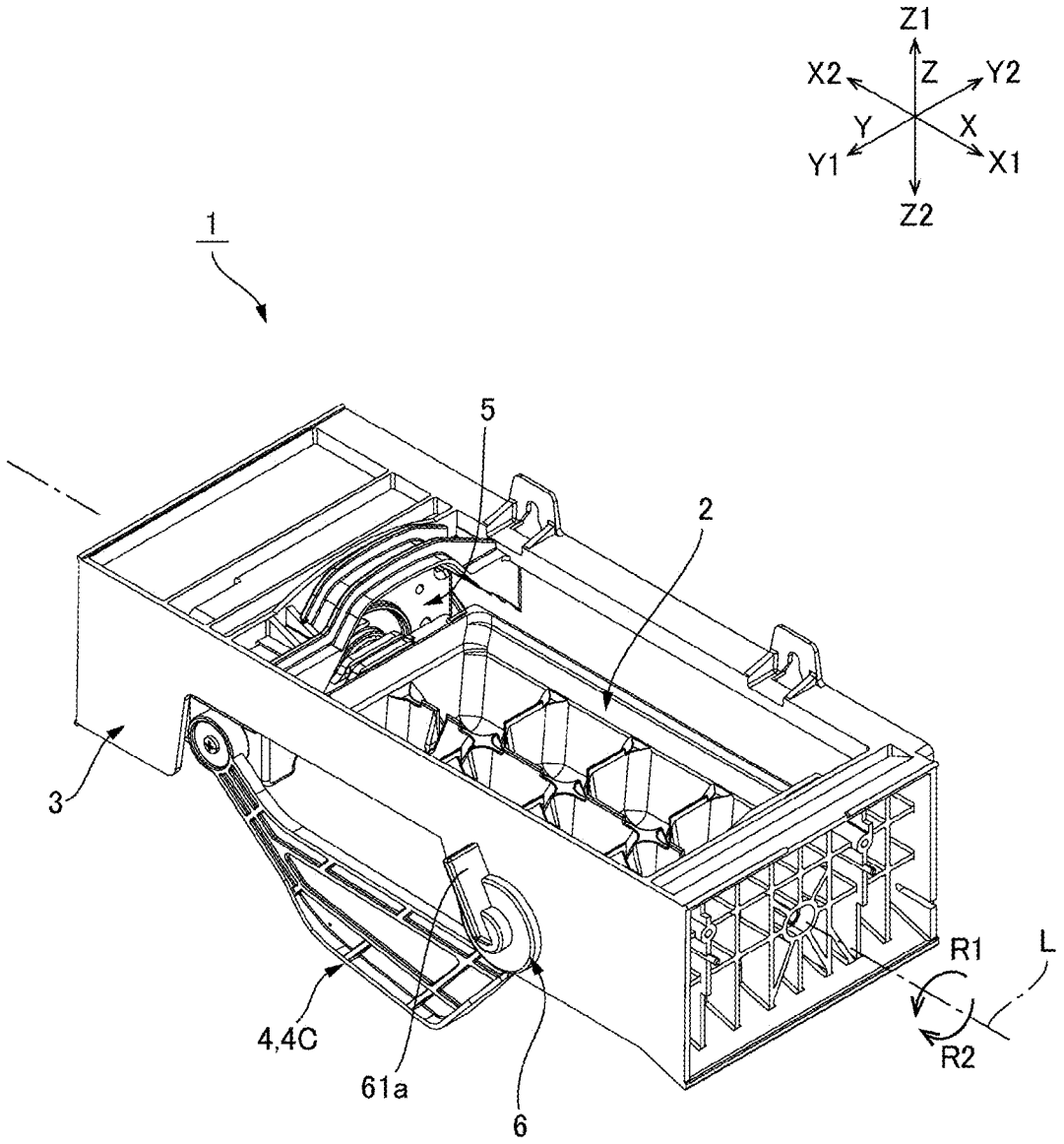
FIG. 2 is a perspective view showing a state that an ice detection lever has been moved to the lowest position in the ice making device shown in FIG. 1.
Figure 3:
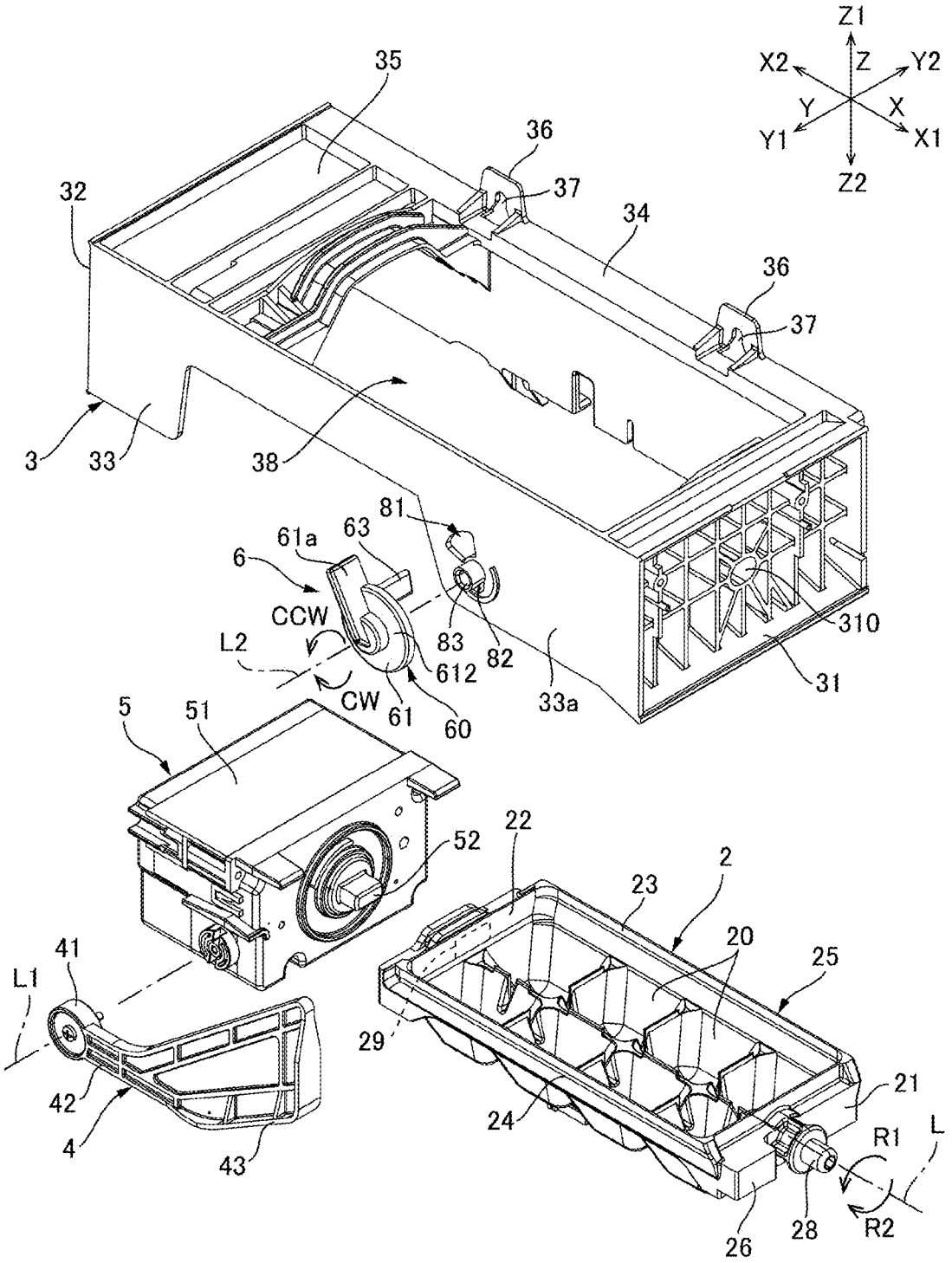
FIG. 3 is an exploded perspective view showing the ice making device in the first embodiment of the present invention.
Figure 4:
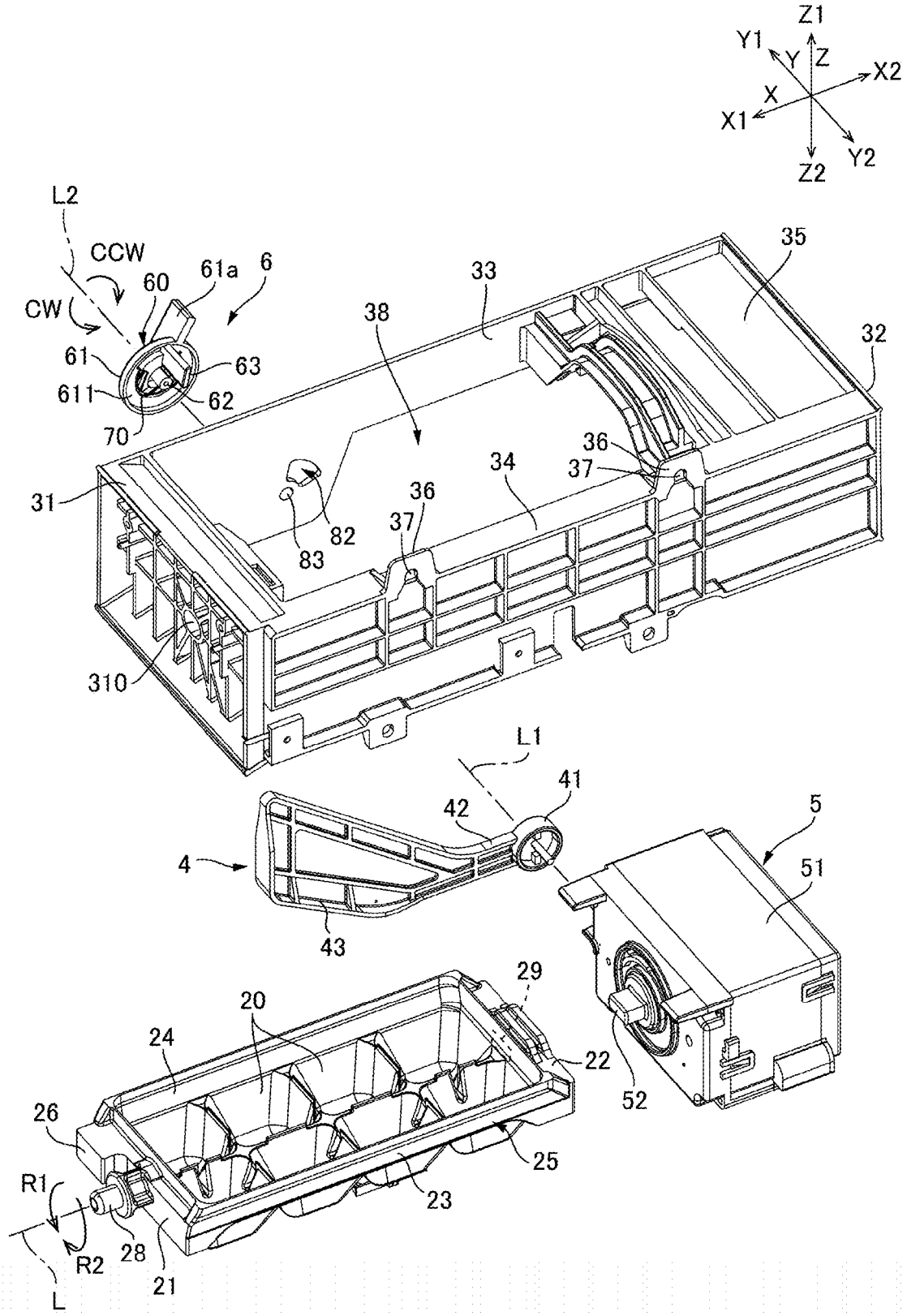
FIG. 4 is an exploded perspective view showing the ice making device in the first embodiment of the present invention which is viewed in a direction different from FIG. 3.
Figure 5:
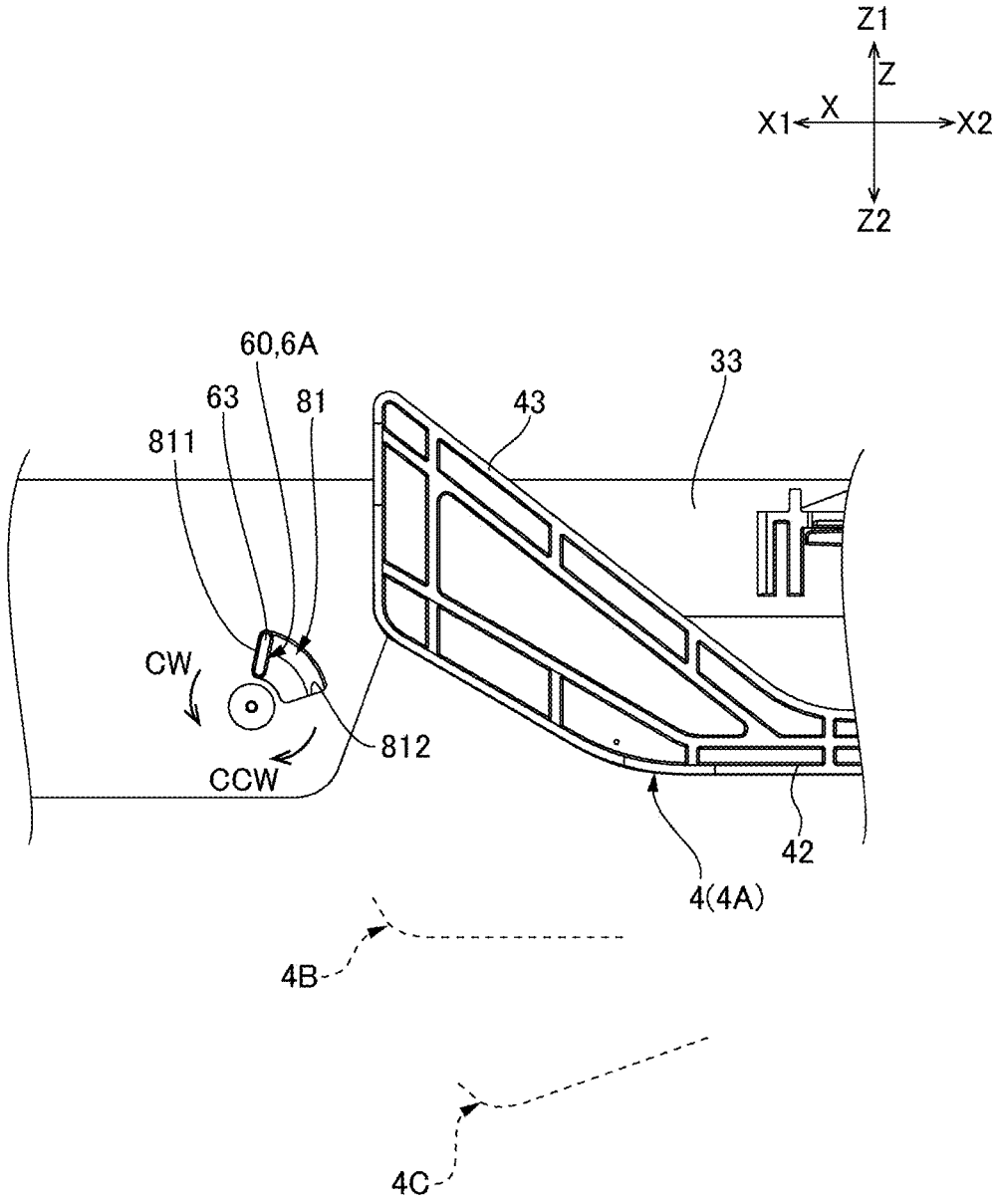
FIG. 5 is an explanatory view showing an operation of an ice detection lever when a restriction member in the first embodiment is located at a first rotation position.
Figure 6:
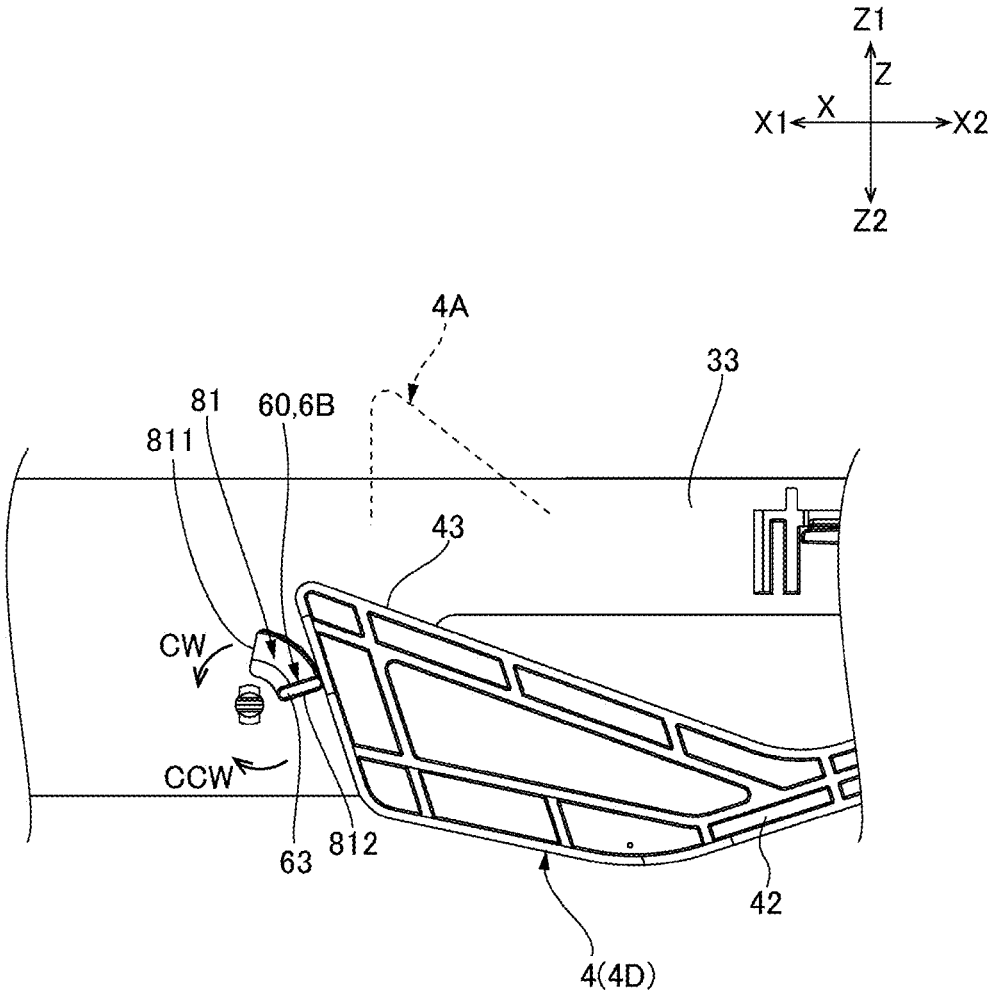
FIG. 6 is an explanatory view showing an operation of the ice detection lever when the restriction member in the first embodiment is located at a second rotation position.

FIG. 1 is a perspective view showing an ice making device 1 to which the present invention is applied. FIG. 2 is a perspective view showing a state that an ice detection lever 4 has been moved to the lowest position 4C in the ice making device 1 shown in FIG. 1. FIG. 3 is an exploded perspective view showing the ice making device 1. FIG. 4 is an exploded perspective view showing the ice making device 1 which is viewed in a direction different from FIG. 3. FIG. 5 is an explanatory view showing an operation of the ice detection lever 4 when a restriction member 60 is located at a first rotation position 6A. FIG. 6 is an explanatory view showing an operation of the ice detection lever 4 when the restriction member 60 is located at a second rotation position 6B.

An ice making device 1 is fixed and used in a freezer chamber of a refrigerator. As shown in FIG. 1, the ice making device 1 includes an ice tray 2, a frame 3 in a frame shape which supports the ice tray 2, an ice detection lever 4 which is provided on an inner side of the frame 3 for detecting an amount of ice pieces stored in an ice storage container (not shown) provided on a lower side with respect to the ice tray 2, a drive part 5 which is supported by the frame 3, and a restriction mechanism 6 for restricting a movement of the ice detection lever 4. The drive part 5 is supplied with power from a refrigerator main body and is controlled by an ice making control part (not shown) provided in the refrigerator main body.

As shown in FIG. 5, the drive part 5 drives the ice detection lever 4 from a standby position 4A (first position) toward an ice detection position 4B (second position) on a lower side at a predetermined timing to perform an ice detection operation which detects an amount of ice pieces stored in the ice storage container. The ice making control part determines that an amount of ice pieces stored in the ice storage container is small when the ice detection lever 4 has been moved lower than the ice detection position 4B, and the ice making control part drives the ice tray 2 through the drive part 5 to discharge ice pieces from the ice tray 2. On the other hand, when the ice detection lever 4 has not been moved lower than the ice detection position 4B, the ice making control part determines that an amount of ice pieces stored in the ice storage container is in a fully filled state and thus, a discharge of ice pieces from the ice tray 2 is not performed. In this embodiment, when the ice tray 2 is to be inverted by the drive part 5 with a rotation axial line "L" as a center, the ice tray 2 is twisted to discharge ice pieces from the ice tray 2.

In the following descriptions, three directions perpendicular to each other are defined as an "X"-axis direction, a "Y"-axis direction and a "Z"-axis direction. The "X"-axis direction is an axial line direction along the rotation axial line "L". Further, the "Z"-axis direction is an upper and lower direction in an installation posture (posture shown in FIG. 1) of the ice making device 1. In the "X"-axis direction, a side where the ice tray 2 is located is referred to as an "X1" direction, and a side where the drive part 5 is located is referred to as an "X2" direction. In the "Z"-axis direction, an upper side is referred to as "Z1", and a lower side is referred to as "Z2". Further, in the "Y"-axis direction, a side where the ice detection lever 4 is located is referred to as a "Y1" direction, and its opposite side is referred to as a "Y2" direction.

(Ice Tray)

The ice tray 2 is made of resin. As shown in FIGS. 3 and 4, the ice tray 2 is provided with a frame part 25 in a rectangular shape and a plurality of water storage recessed parts 20 which are provided on an inner side of the frame part 25. The water storage recessed parts 20 are arranged so that a plurality of pairs having two water storage recessed parts 20 disposed in the "Y"-axis direction is arranged in the "X"-axis direction. The frame part 25 is provided with a first side wall part 21 located on the "X1" direction side of a plurality of the water storage recessed parts 20, a second side wall part 22 located on the "X2" direction side of a plurality of the water storage recessed parts 20, a third side wall part 23 located on the "Y2" direction side of a plurality of the water storage recessed parts 20, and a fourth side wall part 24 located on the "Y1" direction side of a plurality of the water storage recessed parts 20.

A center in the "Y"-axis direction of the first side wall part 21 is provided with a shaft part 28 which is protruded to the "X1" direction side. The shaft part 28 is coaxially provided with the rotation axial line "L". Further, an end part in the "Y1" direction of the first side wall part 21 is provided with a protruded part 26 which is protruded to the "X1" direction side. A center portion in the "Y"-axis direction of the second side wall part 22 is provided with a connecting part 29 which is connected with the drive part 5. The connecting part 29 is located on the rotation axial line "L". A lower face of the ice tray 2 is disposed with a thermistor (not shown) for detecting temperature of the ice tray 2. The thermistor detects temperature of the ice tray 2 and thereby, it is determined by the ice making control part whether water supplied to the water storage recessed parts 20 of the ice tray 2 has been frozen or not.

(Drive Part)

As shown in FIGS. 3 and 4, the drive part 5 includes a case 51 in a rectangular parallelepiped shape which is connected with the frame 3, and an output shaft 52 which is protruded to the "X1" direction side from the case 51. An inside of the case 51 is accommodated with a motor as a drive source and a rotation transmission mechanism structured to transmit a drive force of the motor to the output shaft 52. The output shaft 52 is connected with the connecting part 29 of the ice tray 2.

When ice pieces are to be discharged from the ice tray 2, the drive part 5 turns the output shaft 52 in an "R1" direction. As a result, the ice tray 2 is changed from an upward ice making posture to an obliquely downward ice separation posture. When the ice tray 2 is to be returned to the ice making posture, the output shaft 52 is turned in the "R2" direction.

The frame 3 is made of resin. As shown in FIGS. 3 and 4, the frame 3 is provided with a first wall part 31, a second wall part 32, a third wall part 33 and a fourth wall part 34 which form a rectangular frame shape. Further, the frame 3 is provided with a rectangular support frame part 35 which is connected with an upper end portion of the second wall part 32, an upper end portion on the "X2" direction side of the third wall part 33, and an upper end portion on the "X2" direction side of the fourth wall part 34. The drive part 5 is held by the second wall part 32, an end portion on the "X2" direction side of the third wall part 33, and an end portion on the "X2" direction side of the fourth wall part 34 through the support frame part 35. A rectangular opening part 38 is sectioned on the "X1" direction side with respect to the support frame part 35 by an end edge on the "X1" direction side of the support frame part 35, the first wall part 31, the third wall part 33 and the fourth wall part 34.

The first wall part 31 is located on the "X1" direction side with respect to the ice tray 2 and is extended in the "Y"-axis direction. The second wall part 32 is located on the "X2" direction side with respect to the drive part 5 and is extended in the "Y"-axis direction. The third wall part 33 is located on the "Y1" direction side with respect to the ice tray 2 and the drive part 5 and is extended in the "X"-axis direction to be connected with the first wall part 31 and the second wall part 32. The fourth wall part 34 is located on the "Y2" direction side with respect to the ice tray 2 and the drive part 5 and is extended in the "X"-axis direction to be connected with the first wall part 31 and the second wall part 32.

The first wall part 31 is a wall having a plurality of holes which are formed by a plurality of ribs in a plate shape is connected with each other. The first wall part 31 is provided with a support part 310 which turnably supports the shaft part 28 of the ice tray 2 around the rotation axial line "L". The support part 310 is a circular through hole which penetrates through the first wall part 31 in the "X"-axis direction. The shaft part 28 of the ice tray 2 is supported by the support part 310 and the connecting part 29 is connected with the output shaft 52 of the drive part 5 and, in this state, the ice tray 2 is capable of turning around the rotation axial line "L".

An inner side of the first wall part 31 is provided with an abutted part (not shown) which is abutted with the protruded part 26 of the ice tray 2 when the ice tray 2 is turned in the "R1" direction with the rotation axial line "L" as a center.

An end part in the "Z1" direction of the fourth wall part 34 is provided with fixing parts 36 for fixing the frame 3. The fixing part 36 is protruded from an end part in the "Z1" direction of the fourth wall part 34 to an upper side. In this embodiment, the fixing part 36 is provided at two positions separated in the "X"-axis direction. When the ice making device 1 is to be installed in a freezer chamber, fixing screws are penetrated through respective through holes 37 of the fixing parts 36 from the "Y2" direction side to fix the frame 3 to an inner wall face of the freezer chamber.

(Ice Detection Lever)

As shown in FIGS. 3 and 4, the ice detection lever 4 is provided with a shaft part 41 which is connected with a side face in the "Y1" direction of the drive part 5, a first arm part 42 extended in the "X1" direction from the shaft part 41, and a second arm part 43 extended from an end part in the "X1" direction of the first arm part 42 in an inclined direction with respect to the first arm part 42. The drive part 5 turns the ice detection lever 4 around the rotation axis "L1" to move between a standby position 4A shown in FIG. 1 and the lowest position 4C shown in FIG. 2. As shown in FIG. 1, at the standby position 4A, the second arm part 43 is extended to an obliquely upper side. The ice detection lever 4 is structured so that, when an ice detection operation is to be performed, an edge in the "Z2" direction of the second arm part 43 is extended in a substantially horizontal direction at an ice detection position 4B (see FIG. 5) between the standby position 4A and the lowest position 4C and a contact area with ice pieces becomes large. As shown in FIG. 5, in a case that an ice detection operation is to be performed, when a restriction member 60 is located at a first rotation position 6A, the ice detection lever 4 is permitted to move lower than the ice detection position 4B. Further, as shown in FIG. 6, in a case that an ice detection operation is to be performed, when the restriction member 60 is located at a second rotation position 6B, the ice detection lever 4 is prevented from moving lower than a restriction position 4D.

(Restriction Mechanism)

Figure 7:
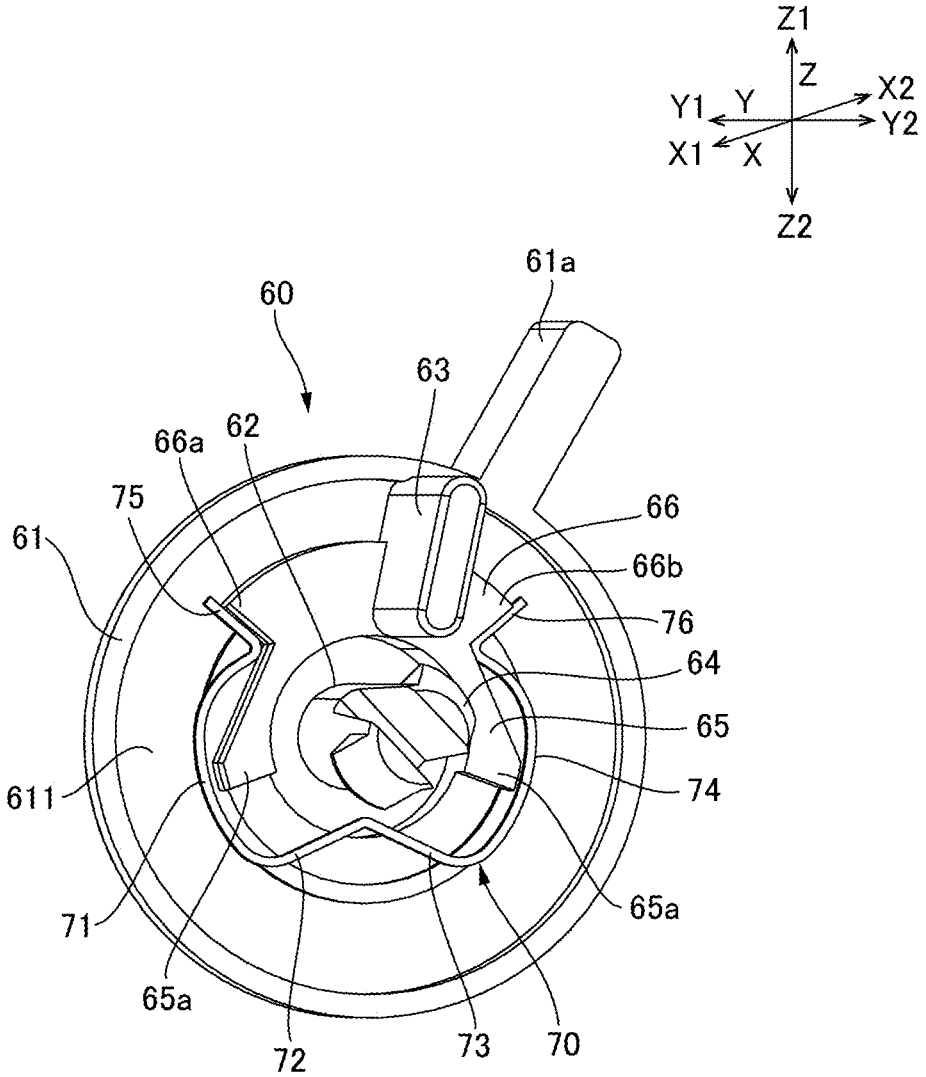
FIG. 7 is a perspective view showing the restriction member and a wire spring in the first embodiment of the present invention.
Figure 8:
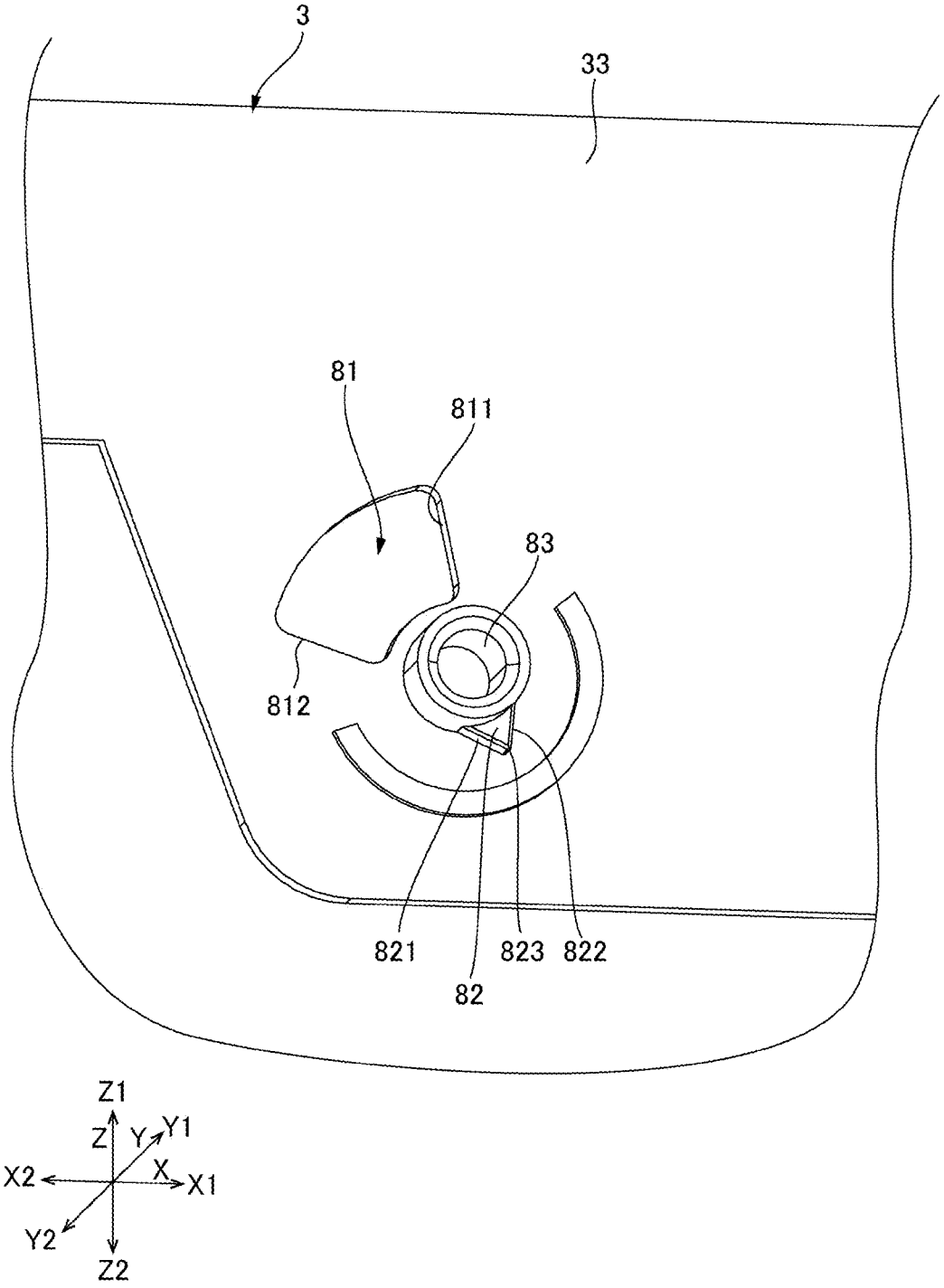
FIG. 8 is a perspective view showing an opening part and a protruded part in the first embodiment of the present invention.

FIG. 7 is a perspective view showing the restriction member 60 and a wire spring 70. FIG. 8 is a perspective view showing an opening part 81 and a protruded part 82. As shown in FIGS. 3 and 4, the restriction mechanism 6 is provided in the third wall part 33 of the frame 3. The restriction mechanism 6 includes the restriction member 60 turnably supported by the third wall part 33 of the frame 3, a wire spring 70 made of metal which is attached to the restriction member 60, an opening part 81 in a circular arc shape which is concentrically formed with a rotation shaft of the restriction member 60 in the third wall part 33 of the frame 3, and a protruded part 82 which is provided on an outer side face 33*a* on the "Y1" direction side of the third wall part 33 of the frame 3.

The restriction member 60 is attached to the outer side face 33*a* in the "Y1" direction of the third wall part 33 of the frame 3. As shown in FIGS. 3, 4 and 7, the restriction member 60 is provided with a circular main body part 61, a shaft part 62 protruded to the "Y2" direction side from an inner face 611 (opposing face) which faces the third wall part 33 of the frame 3 at a center of the main body part 61, and a restriction part 63 which is protruded to the "Y2" direction side from the inner face 611 of the main body part 61.

The shaft part 62 is a rotation shaft of the restriction member 60. The shaft part 62 is inserted into a shaft hole 83 which is provided in the protruded part 82 and penetrates through the third wall part 33. As a result, the restriction member 60 is turnably supported by the third wall part 33 of the frame 3 and is capable of turning around the rotation axis "L2" of the shaft part 62. Further, when the shaft part 62 is inserted into the shaft hole 83, an engaging part 64 provided at a tip end of the shaft part 62 is engaged with an edge of the shaft hole 83. As a result, the restriction member 60 is prevented from disengaging from the frame 3.

The restriction part 63 is formed in a plate shape having some thickness in a circumferential direction with the rotation axis "L2" as a center. The restriction part 63 is penetrated through the opening part 81 and is extended to an inner side of the frame 3. As shown in FIGS. 5 and 6, the restriction member 60 is capable of moving between a first rotation position 6A where the restriction part 63 is abutted with a first opening edge 811 at one end in a circumferential direction of the opening part 81 and a second rotation position 6B where the restriction part 63 is abutted with a second opening edge 812 at the other end of the opening part 81. In other words, when the restriction member 60 is turned in a first turning direction "CCW" from the first rotation position 6A toward the second rotation position 6B, the restriction part 63 is abutted with the second opening edge 812 at the other end of the opening part 81. When the restriction member 60 is turned in a second rotation direction "CW" from the second rotation position 6B toward the first rotation position 6A, the restriction part 63 is abutted with the first opening edge 811 of the opening part 81.

Further, as shown in FIG. 3, the restriction member 60 is provided with an operation part 61*a* which is protruded to the "Y1" direction side on the outer side face 612 of the main body part 61. A user is capable of turning the restriction member 60 around the rotation axis "L2" by holding the operation part 61*a* by fingers.

Further, as shown in FIG. 7, the restriction member 60 is provided with a circular arc rib 65 which surrounds the shaft part 62 on the inner face 611 of the main body part 61. The circular arc rib 65 is protruded to the "Y2" direction side from the inner face 611 of the main body part 61. The circular arc rib 65 is provided with two open ends 65*a*. Further, the circular arc rib 65 is provided with a wall portion 66 on an opposite side to a side where the two open ends 65*a* are provided with respect to the shaft part 62. The wall portion 66 is provided with a first wall face 66*a* which faces the first rotation direction "CCW" and is inclined in the second rotation direction "CW". Further, the wall portion 66 is provided with a second wall face 66*b* which faces the second rotation direction "CW" and is inclined in the first rotation direction "CCW".

As shown in FIG. 7, the wire spring 70 is formed in a line shape. The wire spring 70 is provided with a first spring portion 71 in a circular arc shape, a second spring portion 72 in a straight line shape connected with the first spring portion 71, a third spring portion 73 in a straight line shape connected with the second spring portion 72, and a fourth spring portion 74 in a circular arc shape connected with the third spring portion 73.

The first spring portion 71 is extended toward the first rotation direction "CCW" and is curved in a direction separated from the shaft part 62. The second spring portion 72 is extended in the first rotation direction "CCW" from an end of the first spring portion 71 toward a side of the shaft part 62. The third spring portion 73 is extended in the first rotation direction "CCW" from an end of the second spring portion 72 toward an outer peripheral side. The fourth spring portion 74 is extended in the first rotation direction "CCW" from an end of the third spring portion 73 and is curved in a direction approaching the shaft part 62. As shown in FIG. 7, the first spring portion 71 and the fourth spring portion 74 sandwich the circular arc rib 65. As a result, the wire spring 70 is engaged with the circular arc rib 65. Further, the second spring portion 72 and the third spring portion 73 are located between the two open ends 65*a* of the circular arc rib 65 in a circumferential direction.

Further, the wire spring 70 is provided with a first abutting portion 75 which is extended in the second rotation direction "CW" from an end of the first spring portion 71 on an opposite side to a side of the second spring portion 72 toward an outer peripheral side, and a second abutting portion 76 which is extended in the first rotation direction "CCW" from an end of the fourth spring portion 74 on an opposite side to a side of the third spring portion 73 toward an outer peripheral side. The first abutting portion 75 is capable of abutting with the first wall face 66*a*. The second abutting portion 76 is capable of abutting with the second wall face 66*b*. Therefore, the first abutting portion 75 is abutted with the first wall face 66*a*, or the second abutting portion 76 is abutted with the second wall face 66*b* and thereby, the wire spring 70 is whirl-stopped by the circular arc rib 65 within a predetermined range.

As shown in FIGS. 3, 4 and 8, the protruded part 82 is protruded from the outer side face 33*a* on the "Y1" direction side of the third wall part 33 of the frame 3 to the "Y1" direction. As shown in FIG. 8, an outer peripheral face of the protruded part 82 is provided with a first outer peripheral face portion 821 which is extended in the first rotation direction "CCW" so as to be separated from the shaft hole 83 into which the shaft part 62 is inserted, a second outer peripheral face portion 822 which is extended in the first rotation direction "CCW" from an end on an outer peripheral side of the first outer peripheral face portion 821 so as to approach the shaft part 62, and an edge line 823 formed by an end on an outer peripheral side of the first outer peripheral face portion 821 and an end on an outer peripheral side of the second outer peripheral face portion 822. The first outer peripheral face portion 821, the second outer peripheral face portion 822 and the edge line 823 are located between the two open ends 65*a* of the circular arc rib 65 in a circumferential direction (see FIG. 9).

(Operation of Restriction Mechanism)

Figure 9:
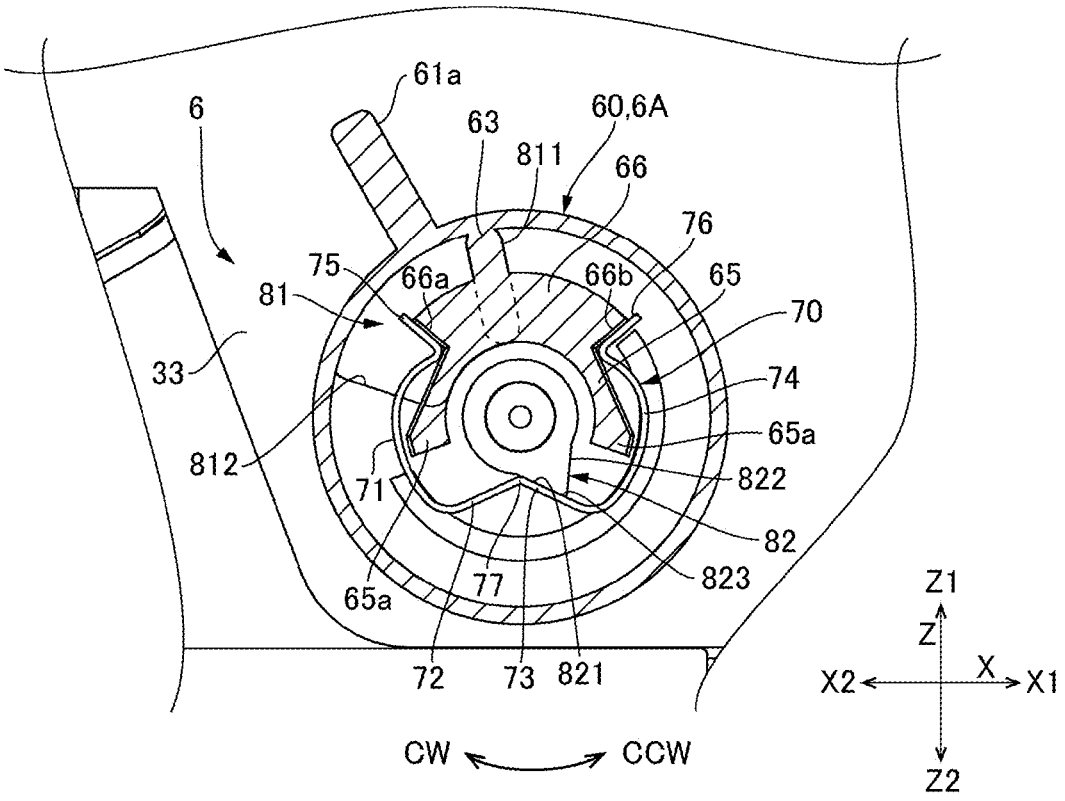
FIG. 9 is an explanatory view showing a state that the restriction member in the first embodiment is located at the first rotation position.
Figure 10:
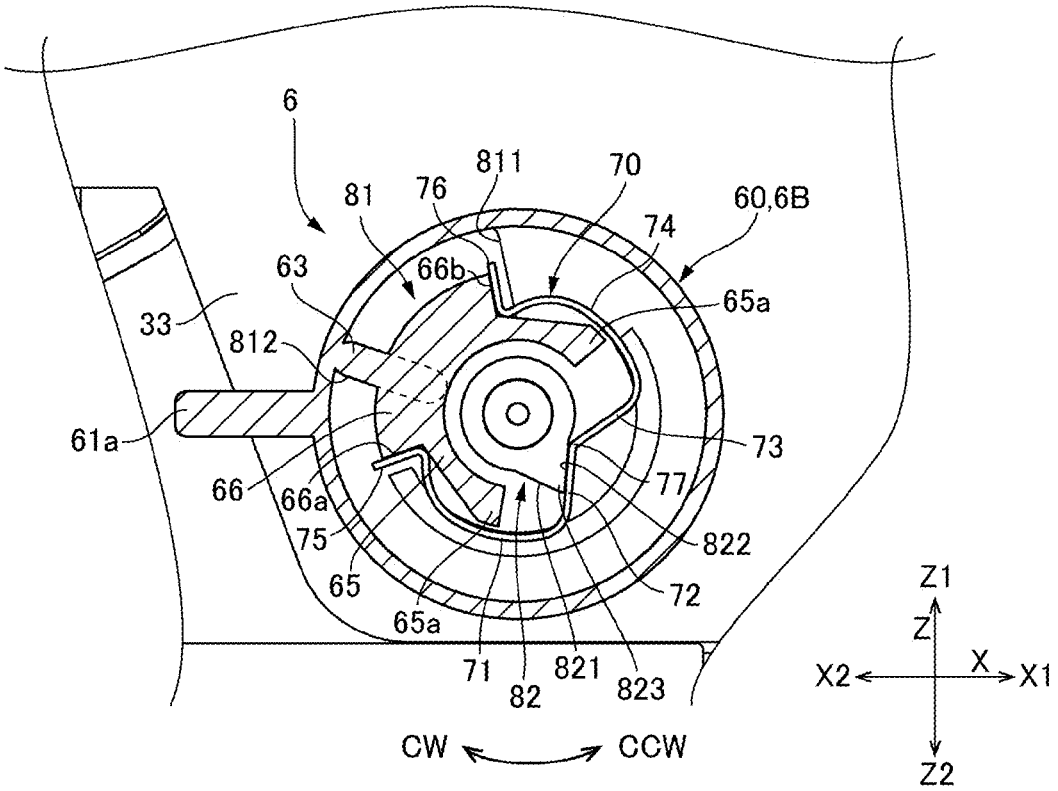
FIG. 10 is an explanatory view showing a state that the restriction member in the first embodiment is located at the second rotation position.
Figure 11:
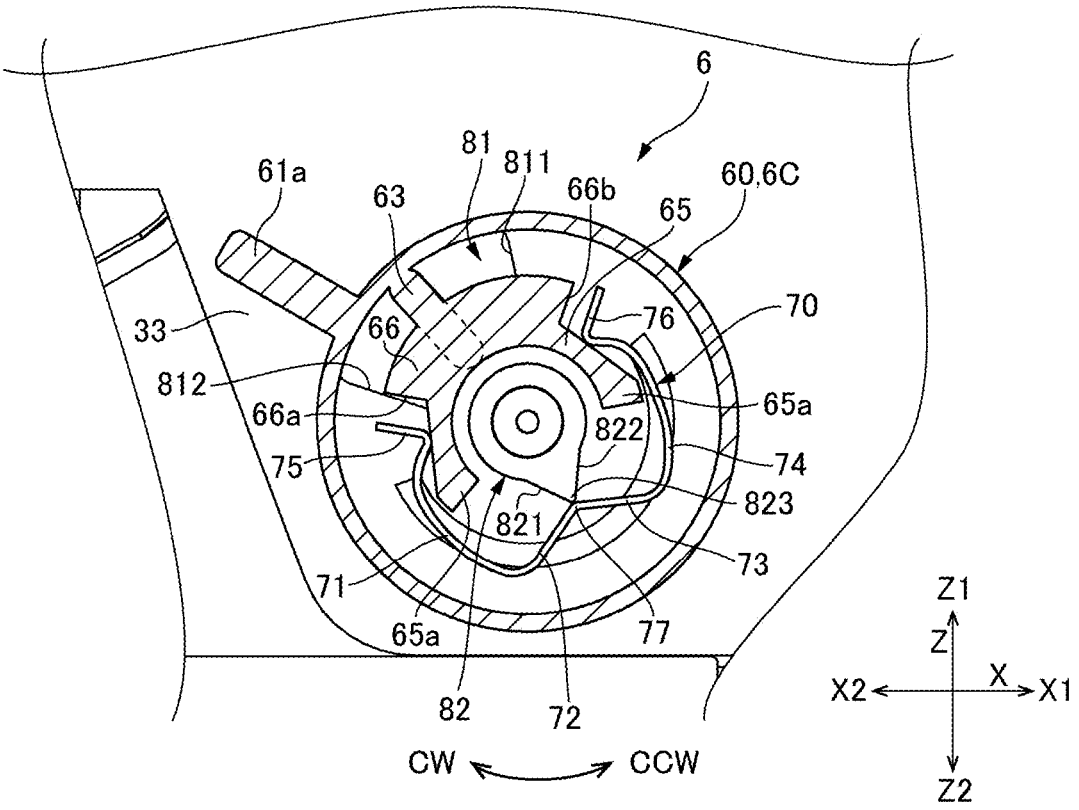
FIG. 11 is an explanatory view showing a state that the restriction member in the first embodiment is located at a third rotation position.

An operation of the restriction mechanism 6 will be described below. FIG. 9 is an explanatory view showing a state that the restriction member 60 is located at the first rotation position 6A. FIG. 10 is an explanatory view showing a state that the restriction member 60 is located at the second rotation position 6B. FIG. 11 is an explanatory view showing a state that the restriction member 60 is located at a third rotation position 6C. FIGS. 9 through 11 are views showing states in which the main body part 61 of the restriction mechanism 6 is not shown and are viewed from the "Y1" direction side.

As shown in FIG. 9, when the restriction member 60 is located at the first rotation position 6A, the protruded part 82 is contacted with the wire spring 70 to elastically deform the wire spring 70 and urges the restriction part 63 to the first opening edge 811 of the opening part 81. More specifically, the first outer peripheral face portion 821 of the protruded part 82 is contacted with the third spring portion 73 of the wire spring 70 to elastically deform the wire spring 70 and urges the restriction part 63 to the first opening edge 811 of the opening part 81. As a result, the restriction member 60 is held at the first rotation position 6A.

Further, as shown in FIG. 10, when the restriction member 60 is located at the second rotation position 6B, the protruded part 82 is contacted with the wire spring 70 to elastically deform the wire spring 70 and urges the restriction part 63 to the second opening edge 812 of the opening part 81. More specifically, the second outer peripheral face portion 822 of the protruded part 82 is contacted with the second spring portion 72 of the wire spring 70 to elastically deform the wire spring 70 and urges the restriction part 63 to the second opening edge 812 of the opening part 81. As a result, the restriction member 60 is held at the second rotation position 6B.

Further, when a user holds the operation part 61*a* to turn the restriction member 60 from the first rotation position 6A to the second rotation position 6B by fingers, in a case that the restriction member 60 is located on the first rotation direction "CCW" side with respect to the third rotation position 3C between the first rotation position 6A and the second rotation position 6B, the second outer peripheral face portion 822 of the protruded part 82 is contacted with the second spring portion 72 of the wire spring 70 to elastically deform the wire spring 70 and turns the restriction member 60 toward the second rotation position 6B.

In this case, as shown in FIG. 11, the third rotation position 6C is a position where the edge line 823 is abutted with a bent part 77 at which the second spring portion 72 and the third spring portion 73 are connected with each other. In other words, the edge line 823 is abutted with the bent part 77 when the restriction member 60 is located at the third rotation position 6C. Therefore, in a case that a user holds the operation part 61*a* to turn the restriction member 60 from the first rotation position 6A to the second rotation position 6B by fingers, when the restriction member 60 is turned over the third rotation position 3C, a state that the first outer peripheral face portion 821 of the protruded part 82 is contacted with the third spring portion 73 of the wire spring 70 is changed to a state that the second outer peripheral face portion 822 of the protruded part 82 is contacted with the second spring portion 72 of the wire spring 70. As a result, a direction that the wire spring 70 urges the restriction member 60 is switched from the second rotation direction "CW" to the first rotation direction "CCW". As a result, the restriction member 60 is turned toward the second rotation position 6B.

In addition, when a user holds the operation part 61*a* to turn the restriction member 60 from the second rotation position 6B to the first rotation position 6A by fingers, in a case that the restriction member 60 is located in the second rotation direction "CW" with respect to the third rotation position 3C, the first outer peripheral face portion 821 of the protruded part 82 is contacted with the third spring portion 73 of the wire spring 70 to elastically deform the wire spring 70 and turns the restriction member 60 toward the first rotation position 6A. More specifically, in a case that a user holds the operation part 61*a* to turn the restriction member 60 from the second rotation position 6B to the first rotation position 6A by fingers, when the restriction member 60 is turned over the third rotation position 3C, a state that the second outer peripheral face portion 822 of the protruded part 82 is contacted with the second spring portion 72 of the wire spring 70 is changed to a state that the first outer peripheral face portion 821 of the protruded part 82 is contacted with the third spring portion 73 of the wire spring 70. Therefore, a direction that the wire spring 70 urges the restriction member 60 is switched from the first rotation direction "CCW" to the second rotation direction "CW". As a result, the restriction member 60 is turned toward the first rotation position GA.

As shown in FIG. 5, when the restriction member 60 is located at the first rotation position 6A, the restriction part 63 permits the ice detection lever 4 to move to a lower side than the ice detection position 4B. More specifically, when the restriction member 60 is located at the first rotation position 6A, the restriction part 63 is separated from a trajectory of the ice detection lever 4 which is moved from the standby position 4A (first position) toward the ice detection position 4B (second position). As a result, the restriction part 63 does not restrict a movement of the ice detection lever 4 and thus, the ice detection lever 4 is permitted to move to a lower side than the ice detection position 4B.

On the other hand, as shown in FIG. 6, when the restriction member 60 is located at the second rotation position 6B, the restriction part 63 prevents the ice detection lever 4 from moving to a lower side than the ice detection position 4B. More specifically, when the restriction member 60 is located at the second rotation position GB, the restriction part 63 is disposed at a restriction position and is capable of abutting with the ice detection lever 4. As a result, when the ice detection lever 4 is moved downward to a restriction position 4D which is set between the standby position 4A and the ice detection position 4B, the second arm part 43 of the ice detection lever 4 is abutted with the restriction part 63 disposed at the restriction position and thus, the restriction part 63 prevents the ice detection lever 4 from moving to the ice detection position 4B.

(Operations and Effects)

In the ice making device 1 in this embodiment, when the restriction member 60 is disposed at the first rotation position 6A where a downward movement of the ice detection lever 4 is permitted, the protruded part 82 provided in the frame 3 is contacted with the wire spring 70 which is attached to the restriction member 60 to elastically deform the wire spring 70 and urges the restriction member 60 to the first opening edge 811 of the opening part 81 provided in the frame 3. In other words, when the restriction member 60 is disposed at the first rotation position 6A, the restriction member 60 is urged to the first opening edge 811 by a shape restoring force generated in the wire spring 70 due to elastic deformation. Therefore, the restriction member 60 is restrained from moving from the first rotation position 6A due to vibration or the like. Further, when the restriction member 60 is disposed at the second rotation position 6B where a downward movement of the ice detection lever 4 is prevented, the protruded part 82 provided in the frame 3 is contacted with the wire spring 70 which is attached to the restriction member 60 to elastically deform the wire spring 70 and urges the restriction member 60 to the second opening edge 812 of the opening part 81 provided in the frame 3. In other words, when the restriction member 60 is disposed at the second rotation position 6B, the restriction member 60 is urged to the second opening edge 812 by a shape restoring force generated in the wire spring 70 due to elastic deformation. Therefore, the restriction member 60 is restrained from moving from the second rotation position 6B. Further, the restriction member 60 is urged by the wire spring 70 made of metal. Therefore, even when the wire spring 70 is repeatedly elastically deformed, the wire spring 70 is less likely to be damaged in comparison with a case that a resin member is repeatedly elastically deformed. Accordingly, the restriction member 60 disposed at the first rotation position 6A and the second rotation position 6B can be restrained from moving from the respective rotation positions.

In a case that the restriction member 60 is located on the first rotation direction "CCW" side with respect to the third rotation position 6C between the first rotation position 6A and the second rotation position 6B, the protruded part 82 is contacted with the wire spring 70 to elastically deform the wire spring 70 and turn the restriction member 60 toward the second rotation position 6B. Further, in a case that the restriction member 60 is located on the second rotation direction "CW" side with respect to the third rotation position 6C, the protruded part 82 is contacted with the wire spring 70 to elastically deform the wire spring 70 and turn the restriction member 60 toward the first rotation position 6A. Therefore, in the ice making device 1, even in a case that the restriction member 60 is moved to a side of the third rotation position GC from the first rotation position 6A and, even in a case that the restriction member 60 is moved to a side of the third rotation position 6C from the second rotation position GB, the restriction member 60 can be returned to the first rotation position 6A or the second rotation position 6B.

Further, the wire spring 70 sandwiches the circular arc rib 65 by the first spring portion 71 and the fourth spring portion 74. Therefore, the wire spring 70 is easily attached to the restriction member 60. Further, when the restriction member 60 is located at the first rotation position 6A, the first outer peripheral face portion 821 of the protruded part 82 is contacted with the third spring portion 73 to elastically deform the wire spring 70 and, when the restriction member 60 is located at the second rotation position 6B, the second outer peripheral face portion 822 of the protruded part 82 is contacted with the second spring portion 72 to elastically deform the wire spring 70. Therefore, when an inclination angle of the third spring portion 73 which is inclined with respect to a radial direction is adjusted, a deforming amount of the wire spring 70 can be adjusted when the first outer peripheral face portion 821 of the protruded part 82 is contacted with the third spring portion 73. As a result, an urging force by which the restriction member 60 is urged to the first opening edge 811 can be adjusted. Similarly, when an inclination angle of the second spring portion 72 which is inclined with respect to a radial direction is adjusted, a deforming amount of the wire spring 70 can be adjusted when the second outer peripheral face portion 822 of the protruded part 82 is contacted with the second spring portion 72. As a result, an urging force by which the restriction member 60 is urged to the second opening edge 812 can be adjusted.

When the restriction member 60 is located at the third rotation position 6C, the edge line 823 is abutted with the bent part 77 where the second spring portion 72 and the third spring portion 73 are connected with each other. Therefore, contact of the wire spring 70 with the protruded part 82 is unstable at the third rotation position 6C. Accordingly, the restriction member 60 can be restrained from staying at the third rotation position 6C.

(Second Embodiment)

Figure 12:
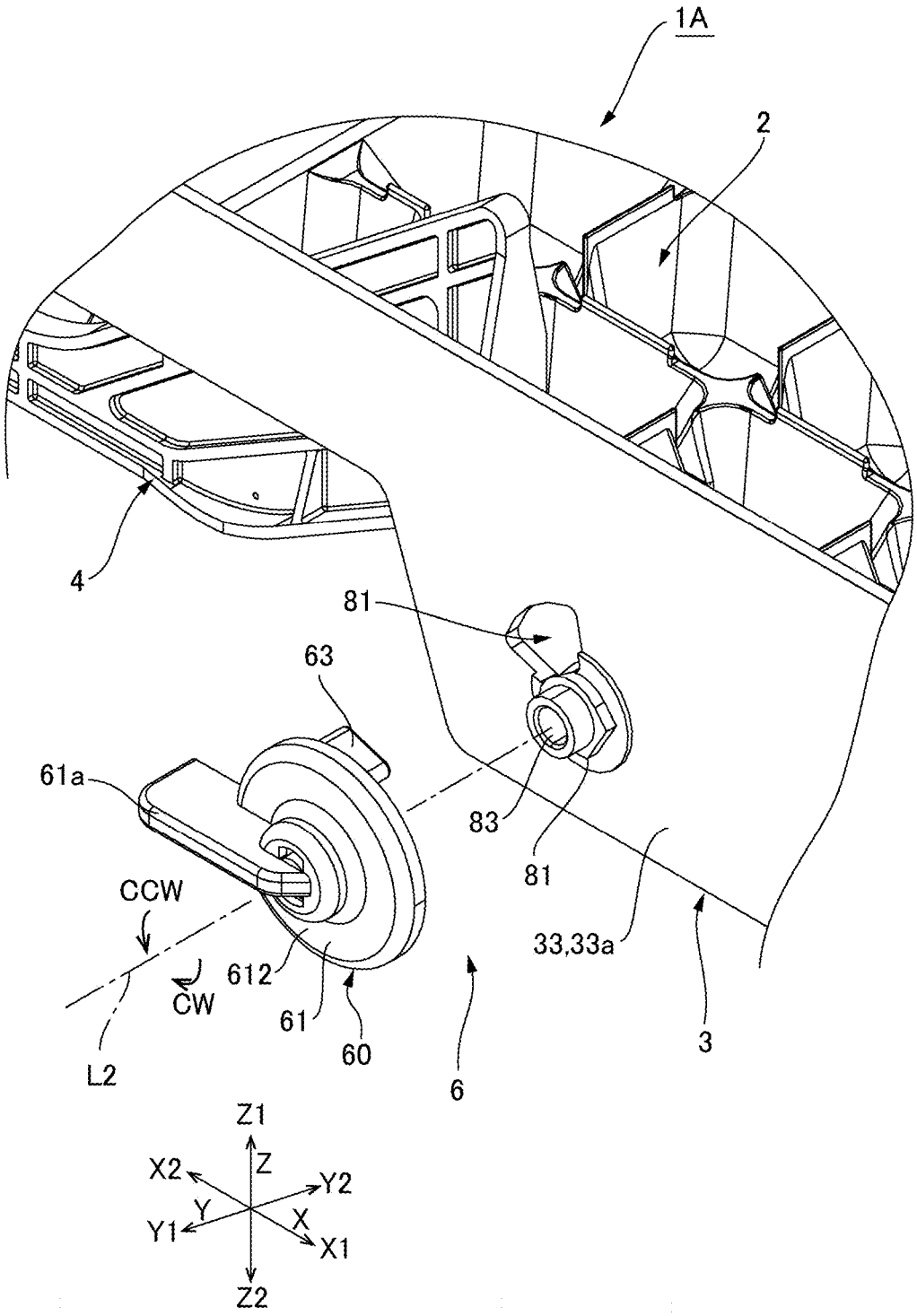
FIG. 12 is an exploded perspective view showing a restriction mechanism which is disassembled in an ice making device in accordance with a second embodiment of the present invention.
Figure 13:
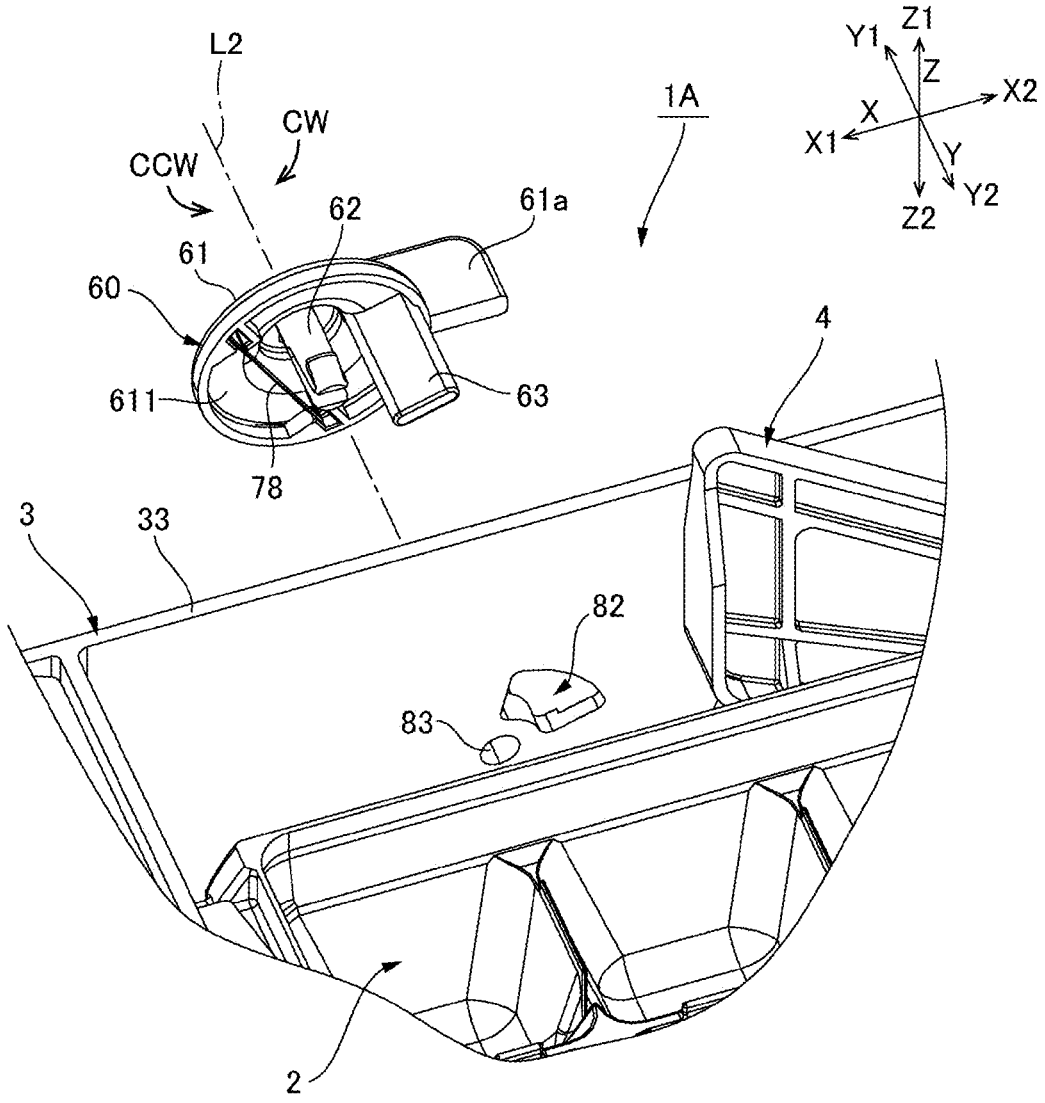
FIG. 13 is an exploded perspective view showing the restriction mechanism which is disassembled in the ice making device in the second embodiment of the present invention which is viewed in a direction different from FIG. 12.
Figure 14:
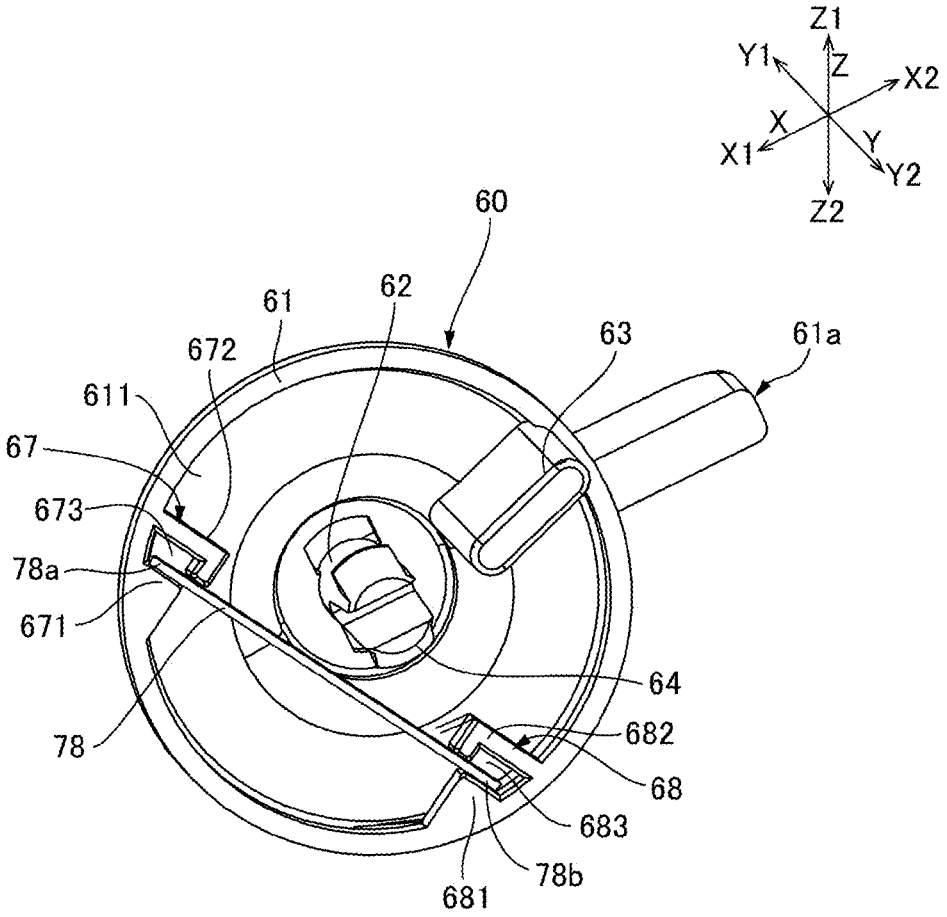
FIG. 14 is a perspective view showing a restriction member and a wire spring in the second embodiment of the present invention.
Figure 15:
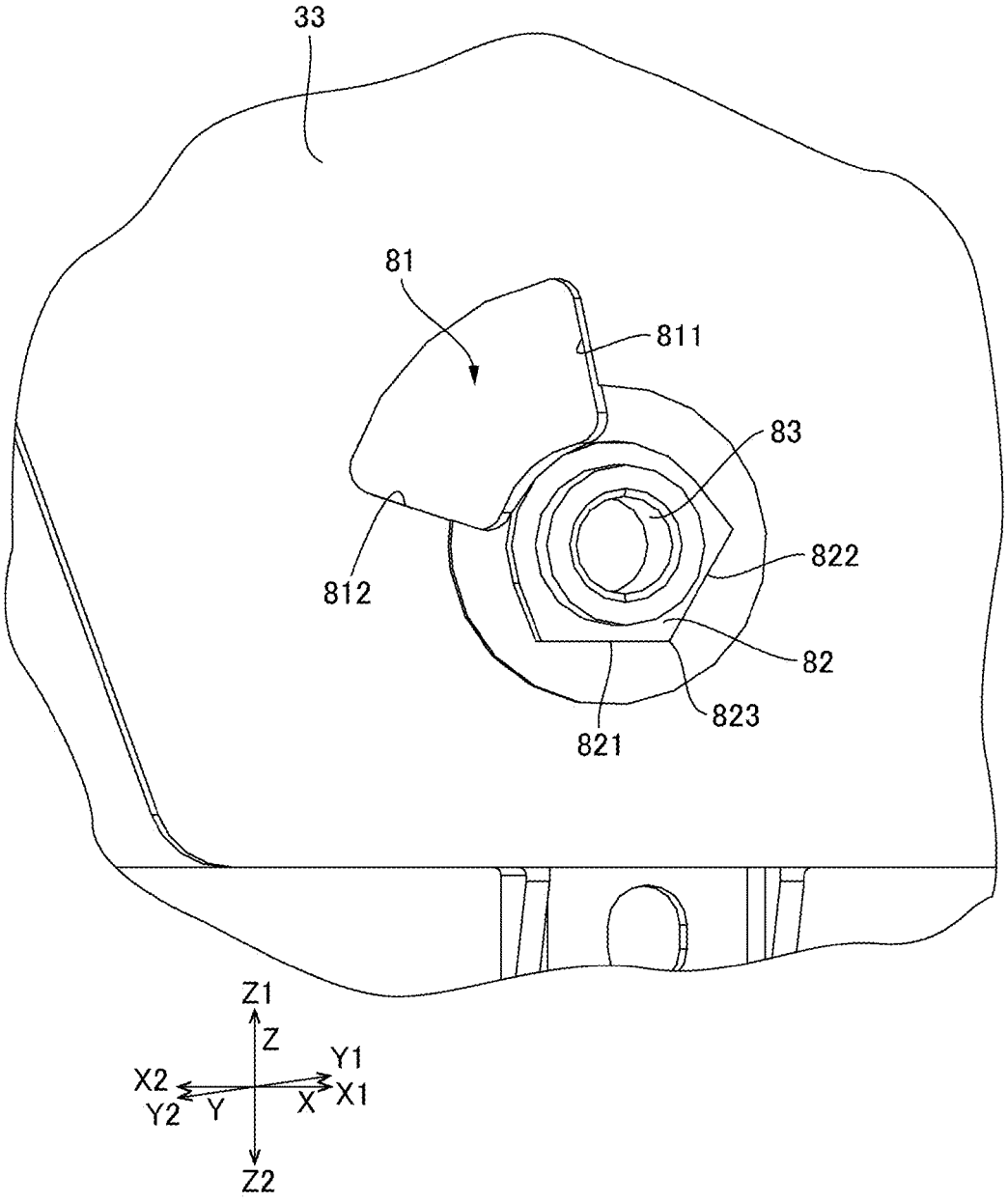
FIG. 15 is a perspective view showing an opening part and a protruded part in the second embodiment of the present invention.

Next, a second embodiment of the present invention will be described below. In an ice making device 1A in accordance with a second embodiment of the present invention, a structure of the restriction mechanism 6 is different from that of the restriction mechanism 6 of the ice making device 1 in the first embodiment of the present invention. More specifically, structures of the restriction member 60 and the wire spring 78 are different from those in the first embodiment. In the second embodiment, the same structures as the first embodiment are indicated with the same reference signs and their descriptions may be omitted. FIG. 12 is an exploded perspective view showing a restriction mechanism 6 which is disassembled in an ice making device 1*a* in a second embodiment of the present invention. FIG. 13 is an exploded perspective view showing the restriction mechanism 6 which is disassembled in the ice making device 1A in the second embodiment which is viewed in a direction different from FIG. 12. FIG. 14 is a perspective view showing a restriction member 60 and a wire spring 78 in the second embodiment of the present invention. FIG. 15 is a perspective view showing an opening part 81 and a protruded part 82 in the second embodiment of the present invention.

(Restriction Mechanism)

A restriction mechanism 6 is, similarly to the first embodiment, provided in the third wall part 33 of the frame 3. As shown in FIGS. 12 and 13, the restriction mechanism 6 includes a restriction member 60 which is turnably supported by the third wall part 33 of the frame 3, a wire spring 78 made of metal which is attached to the restriction member 60, an opening part 81 in a circular arc shape which is concentrically formed with a rotation shaft of the restriction member 60 in the third wall part 33 of the frame 3, and a protruded part 82 which is provided on an outer side face 33*a* on the "Y1" direction side of the third wall part 33 of the frame 3.

The restriction member 60 is attached to the outer side face 33*a* on the "Y1" direction side of the third wall part 33 of the frame 3. As shown in FIGS. 12, 13 and 14, the restriction member 60 is provided with a circular main body part 61, a shaft part 62 protruded at a center of the main body part 61 to the "Y2" direction side from an inner face 611 which faces the third wall part 33 of the frame 3, and a restriction part 63 which is protruded to the "Y2" direction side from the inner face 611 of the main body part 61.

The shaft part 62 is a rotation shaft of the restriction member 60. The shaft part 62 is inserted into a shaft hole 83 which is provided in the protruded part 82 so as to penetrate through the third wall part 33. As a result, the restriction member 60 is turnably supported by the third wall part 33 of the frame 3 and is capable of turning with a rotation axis "L2" of the shaft part 62 as a center. Further, when the shaft part 62 is inserted into the shaft hole 83, an engaging part 64 provided at a tip end of the shaft part 62 is engaged with an edge of the shaft hole 83. As a result, the restriction member 60 is prevented from disengaging from the frame 3.

The restriction part 63 is formed in a plate shape having some thickness in a circumferential direction with the rotation axis "L2" as a center. The restriction part 63 is penetrated through the opening part 81 and is extended to an inner side of the frame 3. The restriction member 60 is capable of moving between a first rotation position 6A where the restriction part 63 is abutted with a first opening edge 811 at one end in a circumferential direction of the opening part 81 and a second rotation position 6B where the restriction part 63 is abutted with a second opening edge 812 at the other end of the opening part 81. In other words, when the restriction member 60 is turned in a first rotation direction "CCW" from the first rotation position 6A toward the second rotation position 6B, the restriction part 63 is abutted with the second opening edge 812 at the other end of the opening part 81. When the restriction member 60 is turned in a second rotation direction "CW" from the second rotation position 6B toward the first rotation position 6A, the restriction part 63 is abutted with the first opening edge 811 of the opening part 81.

Further, as shown in FIG. 12, the restriction member 60 is provided with an operation part 61*a* which is protruded to the "Y1" direction side on an outer side face 612 of the main body part 61. A user is capable of turning the restriction member 60 around the rotation axis "L2" by holding the operation part 61*a* by fingers.

Further, as shown in FIGS. 13 and 14, the restriction member 60 is provided with a first spring support part 67 which supports one end 78*a* of the wire spring 78 and a second spring support part 68 which supports the other end 78*b* of the wire spring 78 on the inner face 611 of the main body part 61. The first spring support part 67 is provided with a first portion 671 which is located on an outer side in a radial direction of the wire spring 78 and supports the wire spring 78, and a second portion 672 which is located on an inner side in the radial direction of the wire spring 78 and supports the wire spring 78. When viewed in the radial direction, the second portion 672 is extended longer than the first portion 671 to an inner side. One end 78*a* of the wire spring 78 is sandwiched by the first portion 671 and the second portion 672 and thereby, the first spring support part 67 supports the one end 78*a* of the wire spring 78.

As shown in FIGS. 13 and 14, the second spring support part 68 is provided with a first portion 681 which is located on an outer side in a radial direction of the wire spring 78 and supports the wire spring 78, and a second portion 682 which is located on an inner side in the radial direction of the wire spring 78 and supports the wire spring 78. When viewed in the radial direction, the second portion 682 is extended longer than the first portion 681 to an inner side. The other end 78*b* of the wire spring 78 is sandwiched by the first portion 681 and the second portion 682 and thereby, the first spring support part 68 supports the other end 78*b* of the wire spring 78.

Further, the second portion 672 is provided with a recessed part 673 which is recessed to an inner side. The second portion 682 is provided with a recessed part 683 which is recessed to an inner side. The recessed part 673 and the recessed part 683 accommodate the one end 78*a* and the other end 78*b* of the wire spring 78 which are moved to an inner side in the radial direction when a center portion of the wire spring 78 between the first spring support part 67 and the second spring support part 68 is elastically deformed to an outer side in the radial direction.

The wire spring 78 is formed in a straight line shape. The wire spring 78 is extended in a straight line shape at a position separated from the shaft part 62 when the wire spring 78 is attached to the first spring support part 67 and the second spring support part 68.

As shown in FIGS. 12, 13 and 15, the protruded part 82 is protruded to the "Y1" direction side from the outer side face 33*a* on the "Y1" direction side of the third wall part 33 of the frame 3. As shown in FIG. 15, the protruded part 82 is provided on its outer peripheral face with a first outer peripheral face portion 821, which is extended in the first rotation direction "CCW" toward a direction separated from the shaft hole 83 into which the shaft part 62 is inserted, a second outer peripheral face portion 822 which is extended in the first rotation direction "CCW" from an end of the outer peripheral side of the first outer peripheral face portion 821 toward a direction approaching the shaft part 62, and an edge line 823 formed by an end on an outer peripheral side of the first outer peripheral face portion 821 and an end on an outer peripheral side of the second outer peripheral face portion 822.

(Operation of Restriction Mechanism)

Figure 16:
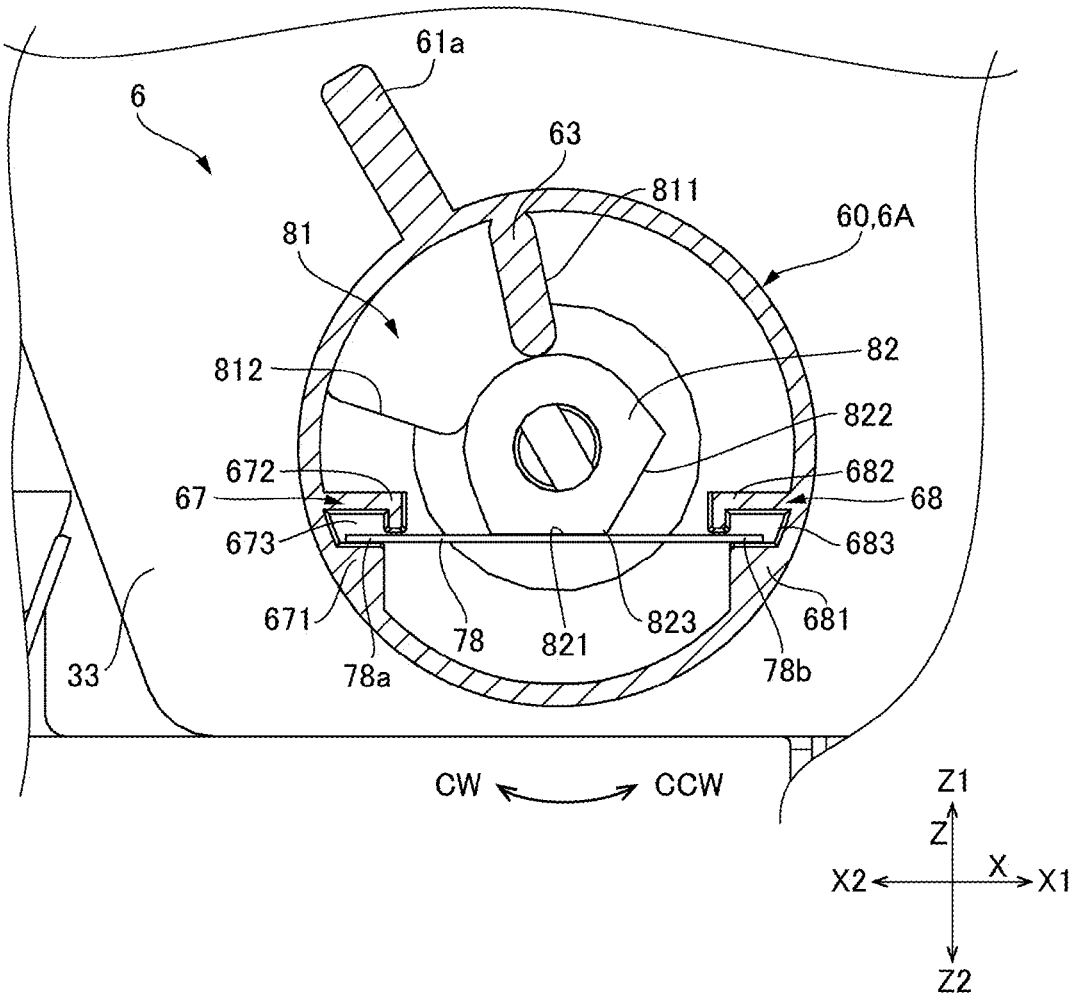
FIG. 16 is an explanatory view showing a state that the restriction member in the second embodiment is located at a first rotation position.
Figure 17:
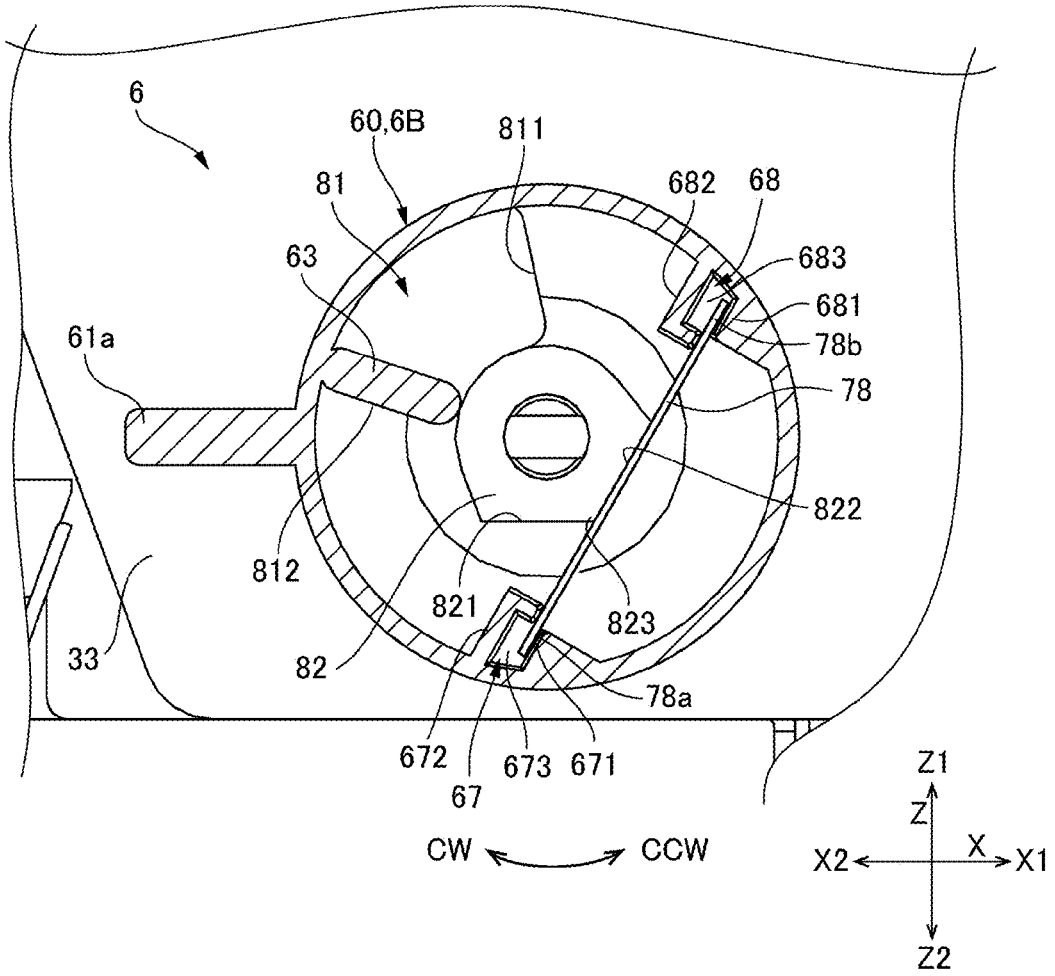
FIG. 17 is an explanatory view showing a state that the restriction member in the second embodiment is located at a second rotation position.
Figure 18:
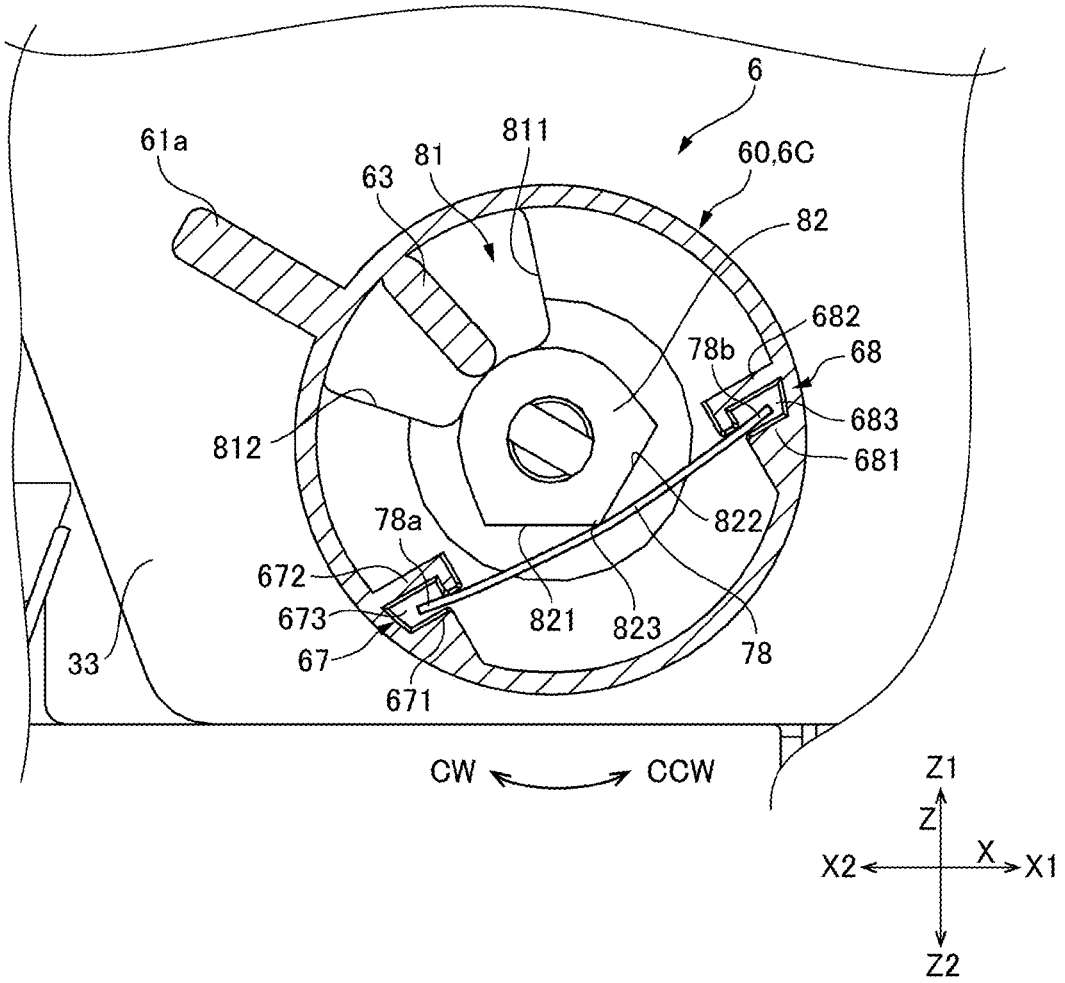
FIG. 18 is an explanatory view showing a state that the restriction member in the second embodiment is located at a third rotation position.

Next, an operation of the restriction mechanism 6 will be described below. FIG. 16 is an explanatory view showing a state that the restriction member 60 is located at the first rotation position 6A. FIG. 17 is an explanatory view showing a state that the restriction member 60 is located at the second rotation position 6B. FIG. 18 is an explanatory view showing a state that the restriction member 60 is located at a third rotation position 6C. FIGS. 16 through 18 show states in which the main body part 61 of the restriction mechanism 6 is omitted and viewed from the "Y1" direction side.

As shown in FIG. 16, when the restriction member 60 is located at the first rotation position 6A, the protruded part 82 is contacted with the wire spring 78 to elastically deform the wire spring 78 and urges the restriction part 63 to the first opening edge 811 of the opening part 81.

Further, as shown in FIG. 17, when the restriction member 60 is located at the second rotation position 6B, the protruded part 82 is contacted with the wire spring 78 to elastically deform the wire spring 78 and urges the restriction part 63 to the second opening edge 812 of the opening part 81. As a result, the restriction member 60 is held at the second rotation position 6B.

Further, when a user holds the operation part 61*a* to turn the restriction member 60 from the first rotation position 6A to the second rotation position 6B by fingers, in a case that the restriction member 60 is located on the first turning direction "CCW" side with respect to the third rotation position 3C between the first rotation position 6A and the second rotation position 6B, the second outer peripheral face portion 822 of the protruded part 82 is contacted with the wire spring 78 to elastically deform the wire spring 78 and turns the restriction member 60 toward the second rotation position 6B.

In this case, as shown in FIG. 18, the third rotation position 6C is a position where the edge line 823 is abutted with the wire spring 78. In other words, the edge line 823 is abutted with the wire spring 78 when the restriction member 60 is located at the third rotation position 6C. Therefore, in a case that a user holds the operation part 61*a* to turn the restriction member 60 from the first rotation position 6A to the second rotation position 6B by fingers, when the restriction member 60 is turned over the third rotation position 3C, a state that the first outer peripheral face portion 821 of the protruded part 82 is contacted with the wire spring 78 is changed to a state that the second outer peripheral face portion 822 of the protruded part 82 is contacted with the wire spring 78. As a result, a direction that the wire spring 78 urges the restriction member 60 is switched from the second rotation direction "CW" to the first rotation direction "CCW". As a result, the restriction member 60 is turned toward the second rotation position 6B.

In addition, when a user holds the operation part 61*a* to turn the restriction member 60 from the second rotation position 6B to the first rotation position 6A by fingers, in a case that the restriction member 60 is located in the second rotation direction "CW" with respect to the third rotation position 3C, the first outer peripheral face portion 821 of the protruded part 82 is contacted with the wire spring 78 to elastically deform the wire spring 78 and turns the restriction member 60 toward the first rotation position 6A. More specifically, in a case that a user holds the operation part 61*a* to turn the restriction member 60 from the second rotation position 6B to the first rotation position 6A by fingers, when the restriction member 60 is turned over the third rotation position 3C, a state that the second outer peripheral face portion 822 of the protruded part 82 is contacted with the wire spring 78 is changed to a state that the first outer peripheral face portion 821 of the protruded part 82 is contacted with the wire spring 78. Therefore, a direction that the wire spring 78 urges the restriction member 60 is switched from the first rotation direction "CCW" to the second rotation direction "CW". As a result, the restriction member 60 is turned toward the first rotation position 6A.

As shown in FIG. 5, when the restriction member 60 is located at the first rotation position 6A, the restriction part 63 permits the ice detection lever 4 to move to a lower side than the ice detection position 4B. More specifically, when the restriction member 60 is located at the first rotation position 6A, the restriction part 63 is separated from a trajectory of the ice detection lever 4 which is moved from the standby position 4A (first position) toward the ice detection position 4B (second position). As a result, the restriction part 63 does not restrict a movement of the ice detection lever 4 and thus, the ice detection lever 4 is permitted to move to a lower side than the ice detection position 4B.

On the other hand, as shown in FIG. 6, when the restriction member 60 is located at the second rotation position 6B, the restriction part 63 prevents the ice detection lever 4 from moving to a lower side than the ice detection position 4B. More specifically, when the restriction member 60 is located at the second rotation position 6B, the restriction part 63 is disposed at a restriction position 4D and is capable of abutting with the ice detection lever 4. As a result, when the ice detection lever 4 is moved down to the restriction position 4D which is set between the standby position 4A and the ice detection position 4B, the second arm part 43 of the ice detection lever 4 is abutted with the restriction part 63 disposed at the restriction position 4D and thus, the restriction part 63 prevents the ice detection lever 4 from moving to the ice detection position 4B.

(Operations and Effects)

In the ice making device 1A in this embodiment of the present invention, similarly to the ice making device 1 in the first embodiment, when the restriction member 60 is disposed at the first rotation position 6A, the restriction member 60 is urged to the first opening edge 811 by a shape restoring force generated in the wire spring 78 due to elastic deformation and thus, the restriction member 60 is restrained from moving from the first rotation position 6A. Further, in the ice making device 1A in this embodiment, when the restriction member 60 is disposed at the second rotation position 6B, the restriction member 60 is urged to the second opening edge 812 by a shape restoring force generated in the wire spring 78 due to elastic deformation and thus, the restriction member 60 is restrained from moving from the second rotation position 6B.

In the ice making device 1A in this embodiment of the present invention, similarly to the ice making device 1 in the first embodiment, even in a case that the restriction member 60 is moved to a side of the third rotation position 6C from the first rotation position 6A and, even in a case that the restriction member 60 is moved to a side of the third rotation position 6C from the second rotation position 6B, the restriction member 60 can be returned to the first rotation position 6A or the second rotation position 6B.

Further, when the restriction member 60 is located at the first rotation position 6A, the first outer peripheral face portion 821 of the protruded part 82 is contacted with the wire spring 78 to elastically deform the wire spring 78 and, when the restriction member 60 is located at the second rotation position 6B, the second outer peripheral face portion 822 of the protruded part 82 is contacted with the wire spring 78 to elastically deform the wire spring 78. Therefore, the protruded part 82 is contacted with the wire spring 78 at a surface at the first rotation position 6A and the second rotation position 6B. As a result, the restriction member 60 can be stably urged to each of the first rotation position 6A and the second rotation position 6B.

When the restriction member 60 is located at the third rotation position 6C, the edge line 823 is abutted with the wire spring 78. Therefore, contact of the wire spring 78 with the protruded part 82 becomes unstable at the third rotation position GC. Accordingly, the restriction member 60 can be restrained from staying at the third rotation position 6C.

The main body part 61 of the restriction member 60 is provided on the inner face 611 facing the frame 3 with the first spring support part 67 which supports one end of the wire spring 78 and the second spring support part 68 which supports the other end of the wire spring 78. Therefore, when the wire spring 78 is attached to the first spring support part 67 and the second spring support part 68, the wire spring 78 is extended in a straight line shape at a position separated from the shaft part 62 and thus, the wire spring 78 can be easily attached to the restriction member 60.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An ice making device comprising:

an ice tray;

a frame which is formed in a frame shape and supports the ice tray;

an ice detection lever which is provided on an inner peripheral side of the frame and is structured to detect an amount of ice pieces stored on a lower side with respect to the ice tray;

a drive part which is structured to drive the ice detection lever to a lower side from a first position and drive the ice tray to discharge ice pieces when the ice detection lever is moved downward to a lower side than a second position; and a restriction mechanism which restricts the ice detection lever from moving to a lower side than a restriction position between the first position and the second position;

wherein the restriction mechanism comprises:

a restriction member which is turnably supported by the frame;

a wire spring which is made of metal and is attached to the restriction member;

an opening part in a circular arc shape which is concentrically formed with a rotation shaft of the restriction member in the frame; and a protruded part which is provided on an outer side face of the frame at a position overlapping with the restriction member when viewed in an axial line direction along the rotation shaft;

wherein the restriction member comprises:

a main body part which is located on an outer side of the frame; and a restriction part which is protruded from the main body part so as to penetrate through the opening part and is extended to an inner side of the frame;

wherein the restriction part is capable of moving between a first rotation position, where the restriction part is abutted with a first opening edge which is one edge in a circumferential direction of the opening part, and a second rotation position where the restriction part is abutted with a second opening edge which is an other edge in the circumferential direction of the opening part;

wherein when the restriction member is located at the first rotation position, the protruded part is contacted with the wire spring to elastically deform the wire spring and urge the restriction member to the first opening edge and, when the restriction member is located at the second rotation position, the protruded part is contacted with the wire spring to elastically deform the wire spring and urge the restriction member to the second opening edge; and wherein when the restriction member is located at the first rotation position, the restriction part is separated from a trajectory of the ice detection lever which is moved from the first position toward the second position and, when the restriction member is located at the second rotation position, the restriction part is disposed at the restriction position to be capable of abutting with the ice detection lever.

2. The ice making device according to claim 1, wherein in a circumferential direction around an axial line of the rotation shaft, when a direction from the first rotation position toward the second rotation position is defined as a first rotation direction, and a direction from the second rotation position toward the first rotation position is defined as a second rotation direction, in a case that the restriction member is located in the first rotation direction with respect to a third rotation position between the first rotation position and the second rotation position, the protruded part is contacted with the wire spring to elastically deform the wire spring and turn the restriction member toward the second rotation position, and in a case that the restriction member is located in the second rotation direction with respect to the third rotation position, the protruded part is abutted with the wire spring to elastically deform the wire spring and turn the restriction member toward the first rotation position.

3. The ice making device according to claim 2, wherein an outer peripheral face of the protruded part comprises:

a first outer peripheral face portion which is extended in the first rotation direction toward a direction separated from the rotation shaft;

a second outer peripheral face portion which is extended in the first rotation direction from an end on an outer peripheral side of the first outer peripheral face portion toward a direction approaching the rotation shaft; and an edge line where an end on an outer peripheral side of the first outer peripheral face portion and an end on an outer peripheral side of the second outer peripheral face portion are connected with each other, the first outer peripheral face portion is contacted with the wire spring to elastically deform the wire spring when the restriction member is located at the first rotation position, and the second outer peripheral face portion is contacted with the wire spring to elastically deform the wire spring when the restriction member is located at the second rotation position.

4. The ice making device according to claim 3, wherein the edge line is contacted with the wire spring to elastically deform the wire spring when the restriction member is located at the third rotation position.

5. The ice making device according to claim 4, wherein the restriction member comprises a circular arc rib surrounding the rotation shaft on a face of the main body part which faces the frame, the wire spring comprises:

a first spring portion in a circular arc shape which is extended in the first rotation direction so as to curve in a direction separated from the rotation shaft;

a second spring portion which is extended in the first rotation direction from an end of the first spring portion toward a side of the rotation shaft;

a third spring portion which is extended in the first rotation direction from an end of the second spring portion toward an outer peripheral side; and a fourth spring portion which is extended from an end of the third spring portion in the first rotation direction so as to curve in a direction approaching the rotation shaft, the first spring portion and the fourth spring portion sandwich the circular arc rib, the second spring portion and the third spring portion are located between two open ends of the circular arc rib in the circumferential direction, the first outer peripheral face portion, the second outer peripheral face portion and the edge line of the protruded part are located between the two open ends of the circular arc rib in the circumferential direction, the first outer peripheral face portion is contacted with the third spring portion to elastically deform the wire spring when the restriction member is located at the first rotation position, and the second outer peripheral face portion is contacted with the second spring portion to elastically deform the wire spring when the restriction member is located at the second rotation position.

6. The ice making device according to claim 5, wherein the edge line is abutted with a bent part where the second spring portion and the third spring portion are connected with each other when the restriction member is located at the third rotation position.

7. The ice making device according to claim 4, wherein the main body part comprises a first spring support part which supports one end of the wire spring and a second spring support part which supports an other end of the wire spring on an opposing face which faces the frame, and the wire spring is extended in a straight line shape at a position separated from the rotation shaft when the wire spring is attached to the first spring support part and the second spring support part.

* * * * *